US011536004B2

(12) United States Patent
Wu

(10) Patent No.: US 11,536,004 B2
(45) Date of Patent: Dec. 27, 2022

(54) EXCAVATOR THAT CONTROLS TOE ANGLE OF BUCKET

(71) Applicant: SUMITOMO HEAVY INDUSTRIES, LTD., Tokyo (JP)

(72) Inventor: Chunnan Wu, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 151 days.

(21) Appl. No.: 15/920,875

(22) Filed: Mar. 14, 2018

(65) Prior Publication Data

US 2018/0230671 A1 Aug. 16, 2018

Related U.S. Application Data

(63) Continuation of application No. PCT/JP2016/077270, filed on Sep. 15, 2016.

(30) Foreign Application Priority Data

Sep. 16, 2015 (JP) ..... JP2015-183321
Mar. 18, 2016 (JP) ..... JP2016-055365

(51) Int. Cl.
*E02F 3/43* (2006.01)
*E02F 9/26* (2006.01)
(Continued)

(52) U.S. Cl.
CPC ..... *E02F 3/435* (2013.01); *E02F 3/32* (2013.01); *E02F 3/437* (2013.01); *E02F 9/2004* (2013.01); *E02F 9/2029* (2013.01); *E02F 9/2041* (2013.01); *E02F 9/22* (2013.01); *E02F 9/265* (2013.01); *F15B 20/007* (2013.01);
(Continued)

(58) Field of Classification Search
CPC ..... E02F 3/425; E02F 3/32
See application file for complete search history.

(56) References Cited

U.S. PATENT DOCUMENTS 4,271,614 A * 6/1981 Albrecht ..... E02F 9/2808 37/446
5,535,532 A 7/1996 Fujii et al.
(Continued)

FOREIGN PATENT DOCUMENTS

EP 2505725 10/2012
JP S59-080555 U 5/1984
(Continued)

OTHER PUBLICATIONS

International Search Report for PCT/JP2016/077270 dated Dec. 20, 2016.

*Primary Examiner* — Jess Whittington
(74) *Attorney, Agent, or Firm* — IPUSA, PLLC

(57) ABSTRACT

An excavator includes a lower traveling body; an upper turning body mounted on the lower traveling body; an attachment attached to the upper turning body; an attitude detecting device configured to detect an attitude of the attachment including a bucket; and a control device configured to control a toe angle of a toe of the bucket with respect to an excavation ground, based on a transition of the attitude of the attachment, information relating to a present shape of the excavation ground, and an operation content of an operation device relating to the attachment.

11 Claims, 17 Drawing Sheets

(51) Int. Cl.

| | |
|---|---|
| ***E02F 9/20*** | (2006.01) |
| ***E02F 3/32*** | (2006.01) |
| ***E02F 9/22*** | (2006.01) |
| ***F15B 20/00*** | (2006.01) |

(52) U.S. Cl.
CPC ..... *E02F 9/2267* (2013.01); *E02F 9/2271* (2013.01); *E02F 9/2285* (2013.01); *E02F 9/2292* (2013.01); *E02F 9/2296* (2013.01); *F15B 2211/55* (2013.01)

(56) References Cited

U.S. PATENT DOCUMENTS 5,688,101 A * 11/1997 Kim ..... E02F 3/3408 414/917
5,903,988 A * 5/1999 Tochizawa ..... E02F 3/437 701/50
5,941,921 A * 8/1999 Dasys ..... E02F 3/434 701/50
6,275,757 B1 * 8/2001 Watanabe ..... E02F 9/2296 37/234
9,109,347 B2 8/2015 Gotou et al.
9,382,687 B2 7/2016 Tsukamoto
9,518,370 B2 12/2016 Tsukamoto
2002/0108486 A1 8/2002 Sannomiya et al.
2005/0046599 A1 3/2005 Sahm et al.
2006/0263189 A1 * 11/2006 Vigholm ..... E02F 9/2221 414/685
2007/0131438 A1 * 6/2007 Brandt ..... A01B 63/112 172/464
2009/0003984 A1 * 1/2009 Osanai ..... E02F 3/3411 414/697
2009/0159302 A1 * 6/2009 Koch ..... E02F 9/265 172/1
2012/0089288 A1 * 4/2012 Kawashima ..... F02D 29/06 180/65.265
2012/0315119 A1 * 12/2012 Magaki ..... E02F 3/43 414/815
2013/0158785 A1 * 6/2013 Fukano ..... E02F 9/261 701/34.4
2013/0330160 A1 * 12/2013 Oka ..... E02F 9/2029 414/687
2015/0033719 A1 * 2/2015 Lawrence ..... E02F 9/2292 60/394
2015/0039189 A1 * 2/2015 Wu ..... E02F 9/2012 701/50
2015/0147147 A1 * 5/2015 Uchiyama ..... E02F 9/2033 414/685
2015/0204053 A1 7/2015 Imaizumi et al.
2015/0240445 A1 * 8/2015 Guo ..... E02F 3/435 701/50
2015/0275471 A1 * 10/2015 Matsumoto ..... E02F 3/432 701/50
2015/0345103 A1 * 12/2015 Daiberl ..... E02F 3/3417 414/715
2015/0354178 A1 * 12/2015 Jeong ..... E02F 9/267 340/438
2016/0193920 A1 * 7/2016 Tsubone ..... B60K 35/00 701/36
2016/0244950 A1 * 8/2016 Kami ..... E02F 9/262
2016/0273186 A1 * 9/2016 Kami ..... E02F 9/2296
2016/0312434 A1 * 10/2016 Shintani ..... E02F 3/3681
2017/0101761 A1 * 4/2017 Wu ..... E02F 9/22
2017/0275852 A1 * 9/2017 Yamashita ..... F15B 11/044
2017/0275854 A1 * 9/2017 Izumikawa ..... E02F 9/2808
2017/0342678 A1 * 11/2017 Iwamura ..... E02F 3/3677
2018/0080199 A1 * 3/2018 Deguchi ..... G01C 15/002

FOREIGN PATENT DOCUMENTS

| | | |
|---|---|---|
| JP | S59-106630 | 6/1984 |
| JP | H06-039794 | 5/1994 |
| JP | H07-158105 | 6/1995 |
| JP | 2872456 | 3/1999 |
| JP | 2001-003399 | 1/2001 |
| JP | 2001-183222 | 7/2001 |
| JP | 2002-097674 | 4/2002 |
| JP | 2003-105795 | 4/2003 |
| JP | 2005-036522 | 2/2005 |
| JP | 2005-076448 | 3/2005 |
| JP | 2010-163995 | 7/2010 |
| JP | 2011-047214 | 3/2011 |
| JP | 2011-058268 | 3/2011 |
| JP | 2011-252338 | 12/2011 |
| JP | 2012-136832 | 7/2012 |
| JP | 2012-172428 | 9/2012 |
| JP | 2013-002058 | 1/2013 |
| JP | 2014-025345 | 2/2014 |
| JP | 5519414 | 6/2014 |
| JP | 2014-122510 | 7/2014 |
| JP | 2014-122511 | 7/2014 |
| JP | 2015-158049 | 9/2015 |
| WO | 1998/059118 | 12/1998 |
| WO | 2008/079192 | 7/2008 |

* cited by examiner

EXCAVATOR THAT CONTROLS TOE ANGLE OF BUCKET

RELATED APPLICATION

The present application is a continuation application of International Application No. PCT/JP2016/077270 filed on Sep. 15, 2016, which claims priority to Japanese Patent Application No. 2015-183321, filed on Sep. 16, 2015, and Japanese Patent Application No. 2016-055365, filed on Mar. 18, 2016. The contents of these applications are incorporated herein by reference in their entirety.

BACKGROUND

1. Technical Field

The present invention relates to an excavator capable of detecting the attitude of an attachment.

2. Description of the Related Art

There is known an excavator that calculates the excavation reaction force acting on a bucket, and that reduces the ground penetration depth of the bucket by raising the boom when the calculated excavation reaction force is higher than an upper limit value set in advance.

SUMMARY

According to an embodiment of the present invention, there is provided an excavator including a lower traveling body; an upper turning body mounted on the lower traveling body; an attachment attached to the upper turning body; an attitude detecting device configured to detect an attitude of the attachment including a bucket; and a control device configured to control a toe angle of a toe of the bucket with respect to an excavation ground, based on a transition of the attitude of the attachment, information relating to a present shape of the excavation ground, and an operation content of an operation device relating to the attachment.

DETAILED DESCRIPTION

In the excavator of the related art, the excavation reaction force is reduced by raising the boom and reducing the ground penetration depth of the bucket, and therefore there are cases where the excavation amount is reduced.

In view of the above, it is desirable to provide an excavator capable of reducing the excavation reaction force while avoiding a decrease in excavation amount.

Figure 1:
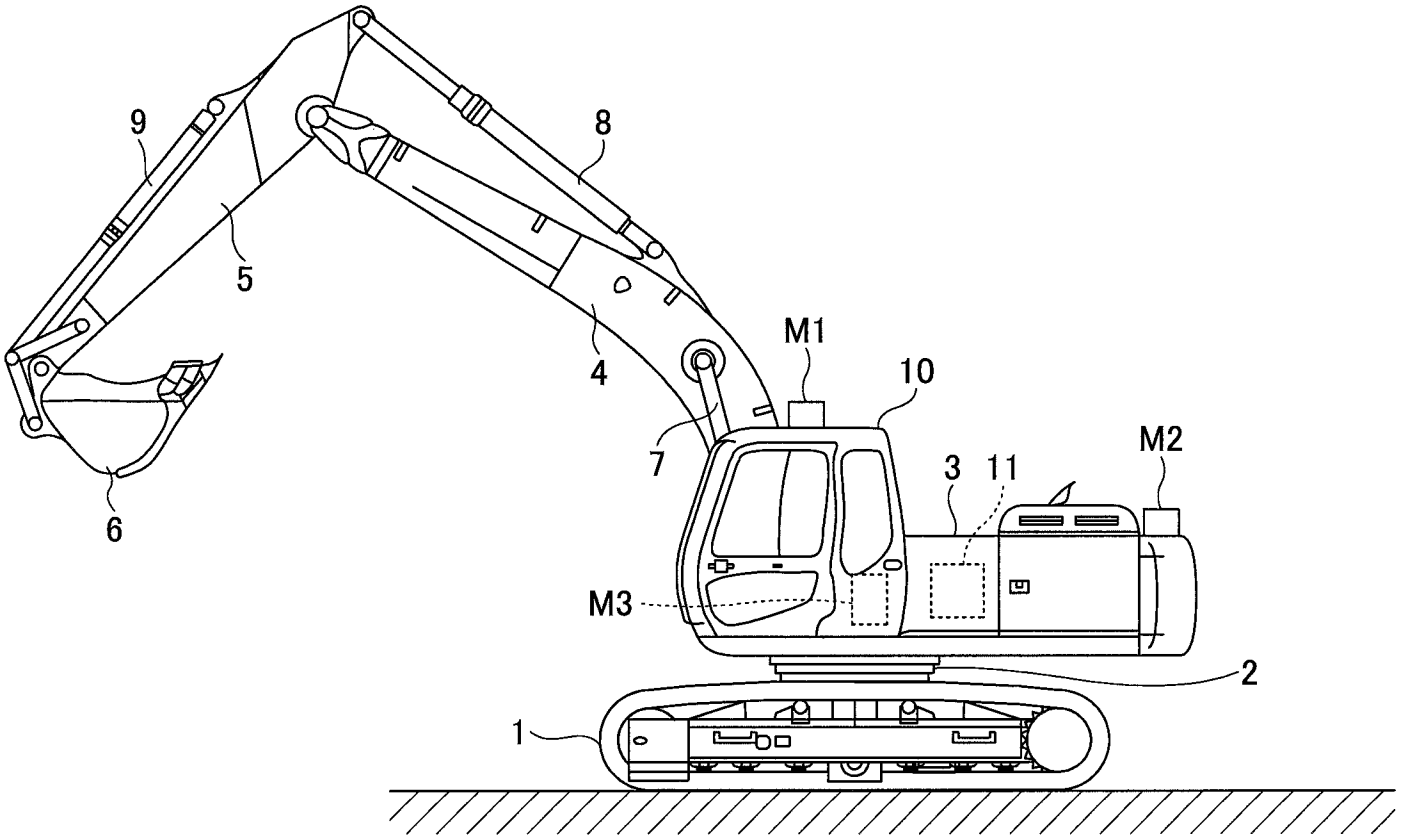
FIG. 1 is a side view of an excavator according to an embodiment of the present invention.

First, with reference to FIG. 1, an excavator (mechanical shovel) that is a construction machine according to an embodiment of the present invention, will be described. FIG. 1 is a side view of an excavator according to an embodiment of the present invention. An upper turning body 3 is mounted on a lower traveling body 1 of the excavator illustrated in FIG. 1, via a turning mechanism 2. A boom 4 is attached to the upper turning body 3. An arm 5 is attached to the front end of the boom 4, and a bucket 6 is attached to the tip of the arm 5. The boom 4, the arm 5, and the bucket 6 as working elements constitute an excavator attachment that is an example of an attachment. The attachment may be another attachment such as a digging attachment, a leveling attachment, and a dredging attachment, etc. The boom 4, the arm 5, and the bucket 6 are hydraulically driven by a boom cylinder 7, an arm cylinder 8, and a bucket cylinder 9, respectively. On the upper turning body 3, a cabin 10 is provided, and a power source such as an engine 11 is installed. A communication device M1, a positioning device M2, and an attitude detecting device M3 are attached to the upper turning body 3.

The communication device M1 controls the communication between the excavator and the outside. In the present embodiment, the communication device M1 controls wireless communication between a GNSS (Global Navigation Satellite System) surveying system and the excavator. Specifically, the communication device M1 acquires topography information of the work site when starting the work by the excavator, at a frequency of once a day, for example. The GNSS surveying system employs, for example, a network type RTK-GNSS positioning method.

The positioning device M2 measures the position and orientation of the excavator. In the present embodiment, the positioning device M2 is a GNSS receiver in which an electronic compass is incorporated, and measures the latitude, the longitude, and the altitude of the position where the excavator is located, and measures the orientation of the excavator.

The attitude detecting device M3 detects the attitude of the attachment. In the present embodiment, the attitude detecting device M3 detects the attitude of the excavator attachment.

Figure 2:
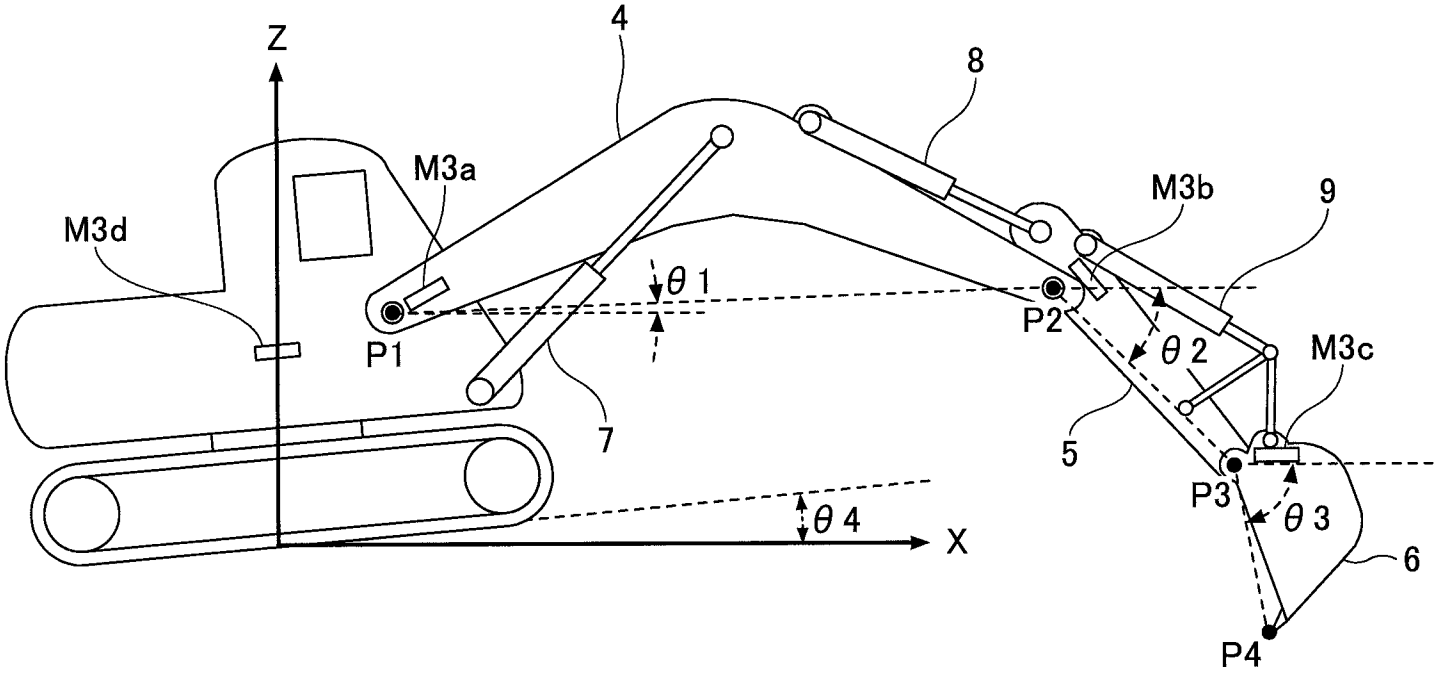
FIG. 2 is a side view of the excavator, illustrating an example of output contents of various sensors constituting an attitude detecting device mounted on the excavator of FIG. 1.

FIG. 2 is a side view of the excavator, illustrating an example of output contents of various sensors constituting the attitude detecting device M3 installed in the excavator of FIG. 1. More specifically, the attitude detecting device M3 includes a boom angle sensor M3*a*, an arm angle sensor M3*b*, a bucket angle sensor M3*c*, and a vehicle body inclination sensor M3*d*.

The boom angle sensor M3*a* is a sensor for acquiring the boom angle and includes, for example, a rotation angle sensor for detecting the rotation angle of the boom foot pin, a stroke sensor for detecting the stroke amount of the boom cylinder 7, and an inclination (acceleration) sensor for detecting the inclination angle of the boom 4, etc. For example, the boom angle sensor M3*a* acquires a boom angle θ1. The boom angle θ1 is an angle of a line segment P1-P2 connecting a boom foot pin position P1 and an arm connecting pin position P2, with respect to the horizontal line, on the XZ plane.

The arm angle sensor M3*b* is a sensor for acquiring the arm angle and includes, for example, a rotation angle sensor for detecting the rotation angle of the arm connecting pin, a stroke sensor for detecting the stroke amount of the arm cylinder 8, and an inclination (acceleration) sensor for detecting the inclination angle of the arm 5, etc. The arm angle sensor M3*b* acquires an arm angle θ2, for example. The arm angle θ2 is an angle of a line segment P2-P3 connecting an arm connecting pin position P2 and a bucket connecting pin position P3, with respect to the horizontal line, on the XZ plane.

The bucket angle sensor M3*c* is a sensor for acquiring the bucket angle, and includes, for example, a rotation angle sensor that detects the rotation angle of the bucket connecting pin, a stroke sensor that detects the stroke amount of the bucket cylinder 9, and an inclination (acceleration) sensor for detecting the inclination angle of the bucket 6, etc. The bucket angle sensor M3*c* acquires, for example, a bucket angle θ3. The bucket angle θ3 is an angle of a line segment P3-P4 connecting the bucket connecting pin position P3 and the bucket toe position P4, with respect to the horizontal line, on the XZ plane.

The vehicle body inclination sensor M3*d* is a sensor that acquires an inclination angle θ4 of the excavator around the Y axis and an inclination angle θ5 (not illustrated) of the excavator around the X axis, and includes, for example, a two axis inclination (acceleration) sensor, etc. The XY plane in FIG. 2 is a horizontal plane.

Figure 3:
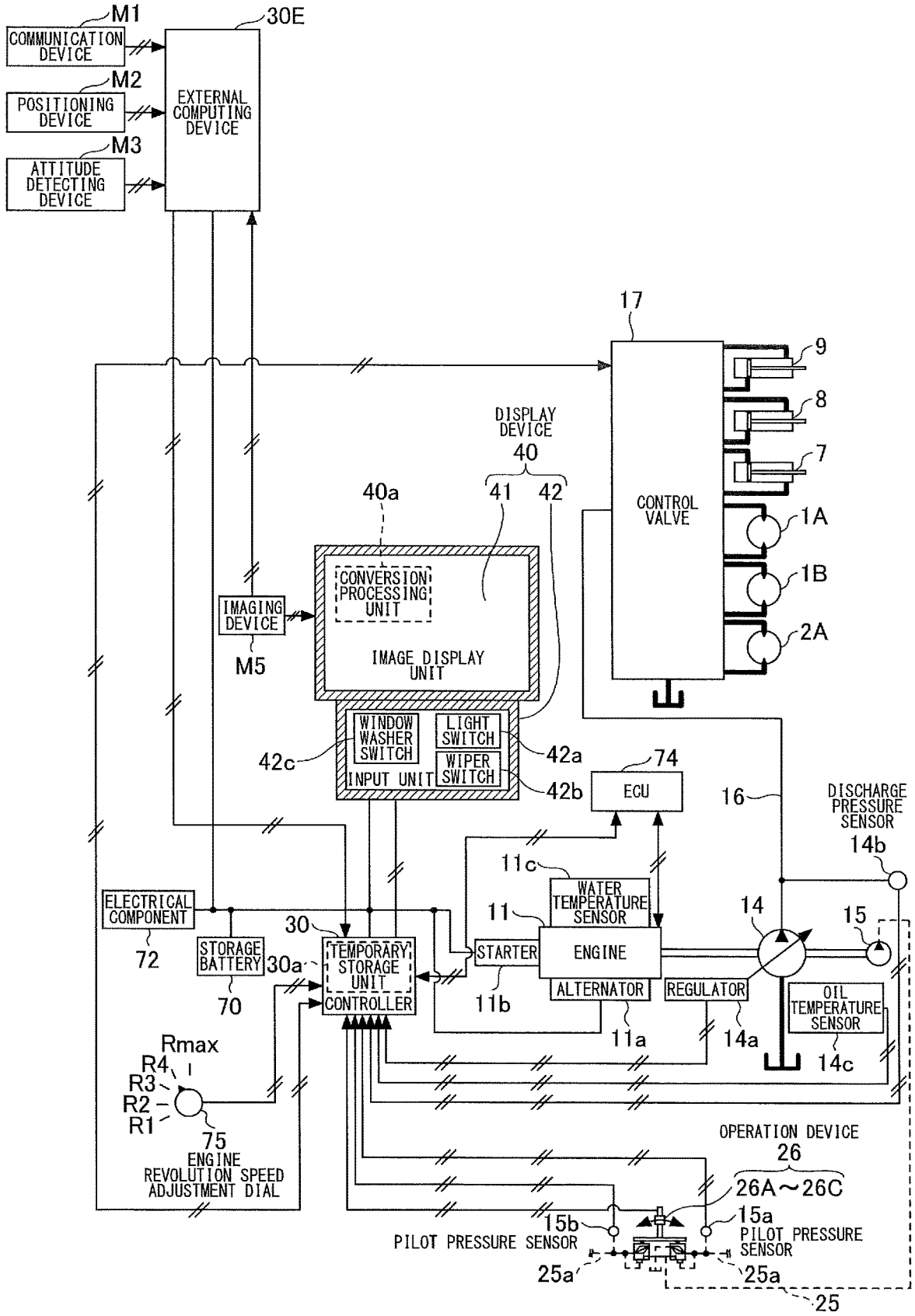
FIG. 3 is a diagram illustrating a configuration example of a basic system installed in the excavator of FIG. 1.

Next, the basic system of the excavator will be described with reference to FIG. 3. The basic system of the excavator mainly includes an engine 11, a main pump 14, a pilot pump 15, a control valve 17, an operation device 26, a controller 30, and an engine control device (ECU) 74, etc.

The engine 11 is a driving source of the excavator, and is, for example, a diesel engine operating to maintain a predetermined revolution speed. An output shaft of the engine 11 is connected to input shafts of the main pump 14 and the pilot pump 15.

The main pump 14 is a hydraulic pump that supplies hydraulic oil to the control valve 17 via a high-pressure hydraulic line 16, and is, for example, a swash plate type variable capacity hydraulic pump. The main pump 14 can change the angle (tilt angle) of the swash plate to adjust the stroke length of the piston, and change the discharge flow rate, that is, the pump output. The swash plate of the main pump 14 is controlled by a regulator 14*a*. The regulator 14*a* varies the tilt angle of the swash plate according to changes in the control current with respect to an electromagnetic proportional valve (not illustrated). For example, in response to an increase in the control current, the regulator 14*a* increases the tilt angle of the swash plate to increase the discharge flow rate of the main pump 14. Furthermore, in accordance with the decrease in the control current, the regulator 14*a* decreases the tilt angle of the swash plate and reduces the discharge flow rate of the main pump 14.

The pilot pump 15 is a hydraulic pump for supplying hydraulic oil to the various hydraulic control devices via a pilot line 25, and is, for example, a fixed capacity hydraulic pump.

The control valve 17 is a hydraulic control valve for controlling the hydraulic system. The control valve 17 operates in accordance with changes in the pressure of the hydraulic oil in a pilot line 25*a* corresponding to the operation direction and the operation amount of levers or pedals 26A to 26C. Hydraulic oil is supplied to the control valve 17 from the main pump 14 through the high-pressure hydraulic line 16. For example, the control valve 17 selectively supplies the hydraulic oil to one element or a plurality of elements among the boom cylinder 7, the arm cylinder 8, the bucket cylinder 9, a left traveling hydraulic motor 1A, a right traveling hydraulic motor 1B, and a turning hydraulic motor 2A. In the following description, the boom cylinder 7, the arm cylinder 8, the bucket cylinder 9, the left traveling hydraulic motor 1A, the right traveling hydraulic motor 1B, and the turning hydraulic motor 2A are collectively referred to as a "hydraulic actuator".

The operation device 26 is a device used by the operator for operating the hydraulic actuator. The operation device 26 receives the supply of hydraulic oil from the pilot pump 15 via the pilot line 25. Then, the hydraulic oil is supplied to pilot ports of flow rate control valves corresponding to the respective hydraulic actuators through the pilot line 25*a*. The pressure of the hydraulic oil supplied to each of the pilot ports is set to a pressure corresponding to the operation direction and the operation amount of the levers or pedals 26A to 26C corresponding to each of the hydraulic actuators.

The controller 30 is a control device for controlling the excavator, and is constituted by, for example, a computer including a CPU, a RAM, and a ROM, etc. The CPU of the controller 30 reads programs corresponding to operations and functions of the excavator from the ROM, loads the programs in the RAM, and executes the programs, thereby executing processes corresponding to the respective programs.

Specifically, the controller 30 controls the discharge flow rate of the main pump 14. For example, the control current is changed according to the negative control pressure, and the discharge flow rate of the main pump 14 is controlled via the regulator 14*a*.

The engine control device (ECU) 74 controls the engine 11. For example, the engine control device (ECU) 74 outputs, to the engine 11, the fuel injection amount, etc., for controlling the revolution speed of the engine 11 according to the engine revolution speed (mode) set by the operator with an engine revolution speed adjustment dial 75 based on an instruction from the controller 30.

Figure 4:
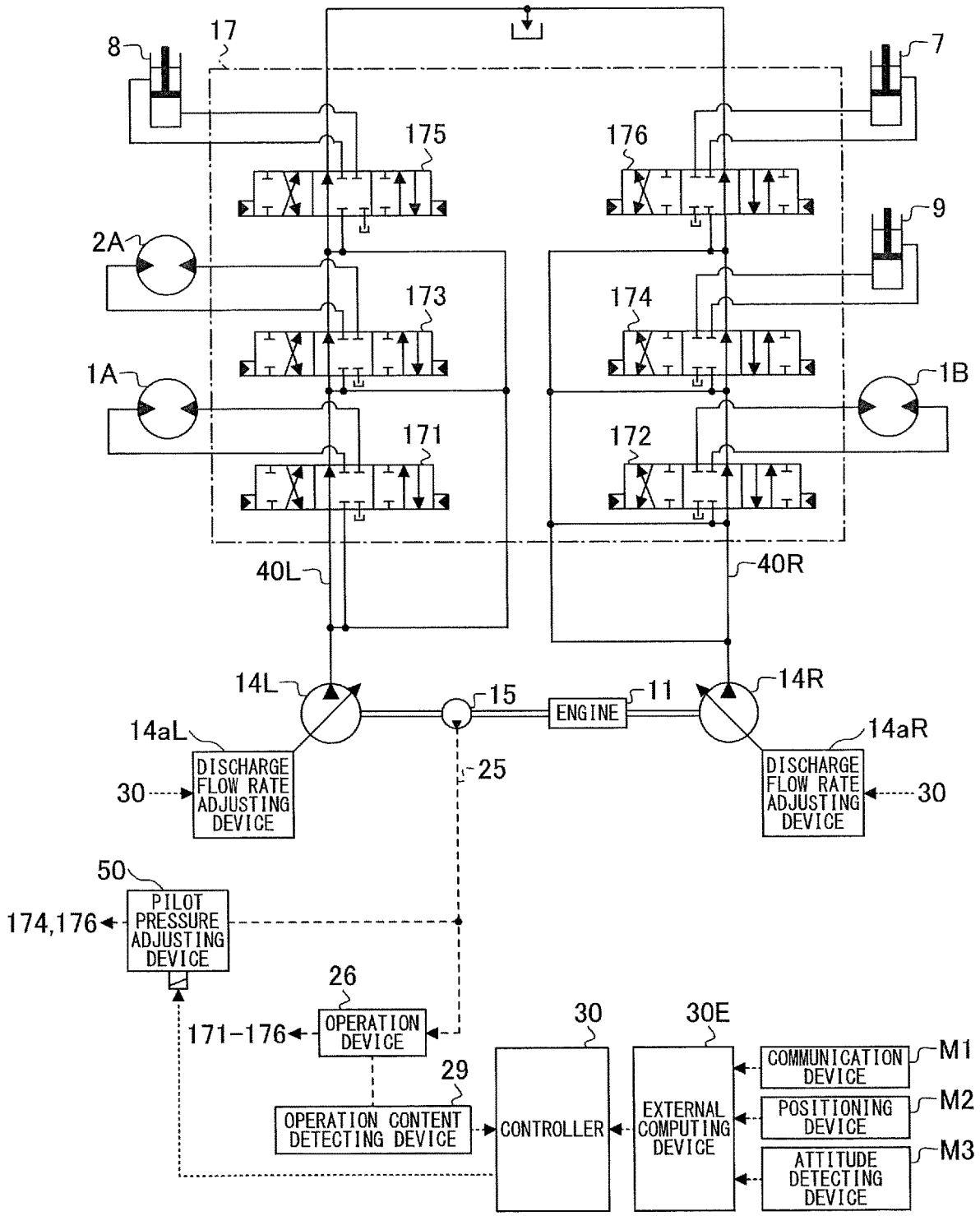
FIG. 4 is a diagram illustrating a configuration example of a driving system installed in the excavator of FIG. 1.

The engine revolution speed adjustment dial 75 is a dial, provided in the cabin 10 for adjusting the engine revolution speed. In the present embodiment, the engine revolution speed can be switched in five stages of Rmax, R4, R3, R2, and R1. FIG. 4 illustrates a state in which R4 is selected with the engine revolution speed adjustment dial 75.

Rmax is the maximum revolution speed of the engine 11, and is selected when priority is given to the work volume. R4 is the second highest engine revolution speed, and is selected when it is desired to achieve both the work volume and fuel economy. R3 and R2 are the third and fourth highest revolution speeds, and are selected when it is desired to operate the excavator with low noise while giving priority to fuel economy. R1 is the lowest engine revolution speed (idling revolution speed), and is the engine revolution speed in the idling mode selected when it is desired to put the engine 11 in the idling state. The revolution speed may be set in multiple stages; for example, Rmax (maximum revolution speed) may be set to 2000 rpm, R1 (idling revolution speed) may be set to 1000 rpm, and the revolution speeds between these may be set as R4 (1750 rpm), R3 (1500 rpm), and R2 (1250 rpm) at every 250 rpm. Then, the engine 11 is controlled to have a constant revolution speed, with the engine revolution speed set with the engine revolution speed adjustment dial 75. Here, an example is given of the engine revolution speed being adjusted in five stages with the engine revolution speed adjustment dial 75; however, the engine revolution speed is not limited to five stages, and may be in any number of stages.

In the excavator, a display device 40 is disposed in the vicinity of the driver's seat of the cabin 10 so as to assist the operator's operations. The operator can input information and instructions to the controller 30 by using an input unit 42 of the display device 40. The excavator can provide information to the operator by displaying the driving situation and control information of the excavator on an image display unit 41 of the display device 40.

The display device 40 includes the image display unit 41 and the input unit 42. The display device 40 is fixed to the console in the cabin 10. In general, the boom 4 is disposed on the right side as viewed from the operator seated in the driver's seat, and the operator often operates the excavator while viewing the arm 5 attached to the front end of the boom 4 and the bucket 6 attached to the tip of the arm 5. The frame on the right front side of the cabin 10 is a portion which blocks the view of the operator. In the present embodiment, the display device 40 is provided by using this portion. The display device 40 is disposed at the portion that originally blocks the view, and therefore the display device 40 itself does not greatly block the operator's view. Depending on the width of the frame, the display device 40 may be configured so that the image display unit 41 is vertically long, so that the entire display device 40 falls within the width of the frame.

In the present embodiment, the display device 40 is connected to the controller 30 via a communication network such as CAN and LIN, etc. The display device 40 may be connected to the controller 30 via an exclusive-use line.

The display device 40 includes a conversion processing unit 40*a* for generating an image to foe displayed on the image display unit 41. In the present embodiment, the conversion processing unit 40*a* generates a camera image to be displayed on the image display unit 41 based on the output of an imaging device M5 attached to the excavator. Therefore, the imaging device M5 is connected to the display device 40, for example, via an exclusive-use line. Furthermore, the conversion processing unit 40*a* generates an image to be displayed on the image display unit 41 based on the output of the controller 30.

The conversion processing unit 40*a* may be implemented as a function of the controller 30, instead of a function of the display device 40. In this case, the imaging device M5 is connected to the controller 30, instead of the display device 40.

The display device 40 includes a switch panel as the input unit 42. The switch panel is a panel including various hardware switches. In the present embodiment, the switch panel includes a light switch 42*a*, a wiper switch 42*b*, and a window washer switch 42*c* as hardware buttons. The light switch 42*a* is a switch for switching on/off of a light attached to the outside of the cabin 10. The wiper switch 42*b* is a switch for switching between operation/stop of the wiper. The window washer switch 42*c* is a switch for injecting the window washer fluid.

The display device 40 operates by receiving power supply from a storage battery 70. The storage battery 70 is charged with electric power generated by an alternator 11*a* (generator). The electric power of the storage battery 70 is also supplied to electrical components 72, etc., of the excavator other than the controller 30 and the display device 40. A starter 11*b* of the engine 11 is driven by electric power from the storage battery 70 and starts the engine 11.

The engine 11 is controlled by the engine control device (ECU) 74. Various kinds of data indicating the state of the engine 11 (for example, data indicating the cooling water temperature (physical quantity) detected by a water temperature sensor 11*c* ) are constantly transmitted from the ECU 74 to the controller 30. The controller 30 can accumulate this data in a temporary storage unit (memory) 30*a* and can transmit the data to the display device 40 when necessary.

Furthermore, various kinds of data are supplied to the controller 30 and stored in the temporary storage unit 30*a* as follows.

Data indicating the tilt angle of the swash plate is supplied from the regulator 14*a* to the controller 30. Data indicating the discharge pressure of the main pump 14 is sent from a discharge pressure sensor 14*b* to the controller 30. These data items (data representing physical quantities) are stored in the temporary storage unit 30*a*. An oil temperature sensor 14*c* is provided in a pipe line between the main pump 14 and a tank in which the hydraulic oil sucked by the main pump 14 is stored. Data indicating the temperature of the hydraulic oil flowing through the pipe line is supplied from the oil temperature sensor 14*c* to the controller 30.

When the levers or pedals 26A to 26C are operated, the pilot pressure sent to the control valve 17 through the pilot line 25*a* is detected by pilot pressure sensors 15*a* and 15*b*. Then, data indicating the pilot pressure is supplied to the controller 30.

From the engine revolution speed adjustment dial 75, data indicating the setting state of the engine revolution speed, is constantly transmitted to the controller 30.

An external computing device 30E is a control device that performs various computations based on outputs of the communication device M1, the positioning device M2, the attitude detecting device M3, and the imaging device M5, etc., and outputs the computation result to the controller 30. In the present embodiment, the external computing device 30E operates by receiving the supply of electric power from the storage battery 70.

FIG. 4 is a diagram illustrating a configuration example of a driving system installed in the excavator of FIG. 1; in the driving system, a mechanical power transmission line, a high pressure hydraulic line, a pilot line, and an electric control line are indicated by double lines, solid lines, dashed lines, and dotted lines, respectively.

The driving system of the excavator mainly includes the engine 11, the main pumps 14L and 14R, discharge flow rate adjusting devices 14*a*L and 14*a*R, the pilot pump 15, the control valve 17, the operation device 26, an operation content detecting device 29, the controller 30, the external computing device 30E, and a pilot pressure adjusting device 50.

The control valve 17 includes flow rate control valves 171 to 176 for controlling the flow of hydraulic oil discharged from the main pumps 14L and 14R. The control valve 17 selectively supplies hydraulic oil, which is discharged from the main pumps 14L and 14R, to one element or a plurality of elements among the boom cylinder 7, the arm cylinder 8, the bucket cylinder 9, the left traveling hydraulic motor 1A, the right traveling hydraulic motor 1B, and the turning hydraulic motor 2A, through the flow rate control valves 171 to 176.

The operation device 26 is a device used by the operator for operating the hydraulic actuator. In the present embodiment, the operation device 26 supplies the hydraulic oil discharged by the pilot pump 15 to the pilot ports of the flow rate control valves corresponding to the respective hydraulic actuators, through the pilot line 25.

The operation content detecting device 29 is a device that detects the operation content of the operator using the operation device 26. In the present embodiment, the operation content detecting device 29 detects the operation direction and the operation amount of a lever or a pedal as the operation device 26 corresponding to each of the hydraulic actuators, in the form of pressure, and outputs the detected value to the controller 30. The operation content of the operation device 26 may be derived by using outputs of sensors other than the pressure sensor, such as a potentiometer.

The main pumps 14L and 14R driven by the engine 11 circulate hydraulic oil to the hydraulic oil tank via center bypass pipe lines 40L and 40R.

The center bypass pipe line 40L is a high pressure hydraulic line passing through the flow rate control values 171, 173, and 175 disposed in the control valve 17. The center bypass pipe line 40R is a high pressure hydraulic line passing through the flow rate control valves 172, 174, and 176 disposed in the control valve 17.

The flow rate control valves 171, 172, 173 are spool valves that control the flow rate and flow direction of hydraulic oil flowing in and out of the left traveling hydraulic motor 1A, the right traveling hydraulic motor 1B, and the turning hydraulic motor 2A.

The flow rate control valves 174, 175, and 176 are spool valves that control the flow rate and flow direction of hydraulic oil flowing in and out of the bucket cylinder 9, the arm cylinder 8, and the boom cylinder 7.

The discharge flow rate adjusting devices 14*a*L and 14*a*R are functional elements for adjusting the discharge flow rates of the main pumps 14L and 14R. In the present embodiment, the discharge flow rate adjusting device 14*a*L is a regulator, which increases or decreases the swash plate tilt angle of the main pump 14L according to a control instruction from the controller 30. Furthermore, the discharge flow rate adjusting device 14*a*L adjusts the discharge flow rate of the main pump 14L by increasing or decreasing the swash plate tilt angle to increase or decrease the displacement volume of the main pump 14L. More specifically, the discharge flow rate adjusting device 14*a*L increases the discharge flow rate of the main pump 14L by increasing the swash plate tilt angle and increasing the displacement volume, as the control current output from the controller 30 increases. The same applies to the adjustment of the discharge flow rate of the main pump 14R by the discharge flow rate adjusting device 14*a*R.

The pilot pressure adjusting device 50 is a functional element for adjusting the pilot pressure supplied to the pilot port of the flow rate control valve. In the present embodiment, the pilot pressure adjusting device 50 is a pressure reducing valve that increases/decreases the pilot pressure by using the hydraulic oil discharged from the pilot pump 15 in accordance with the control current output from the controller 30. With this configuration, the pilot pressure adjusting device 50 can open and close the bucket 6 in accordance with the control current from the controller 30, regardless of the operation of the bucket operation lever by the operator. Furthermore, the boom 4 can be raised in accordance with the control current from the controller 30, regardless of the operation of the boom operation lever by the operator.

Figure 5:
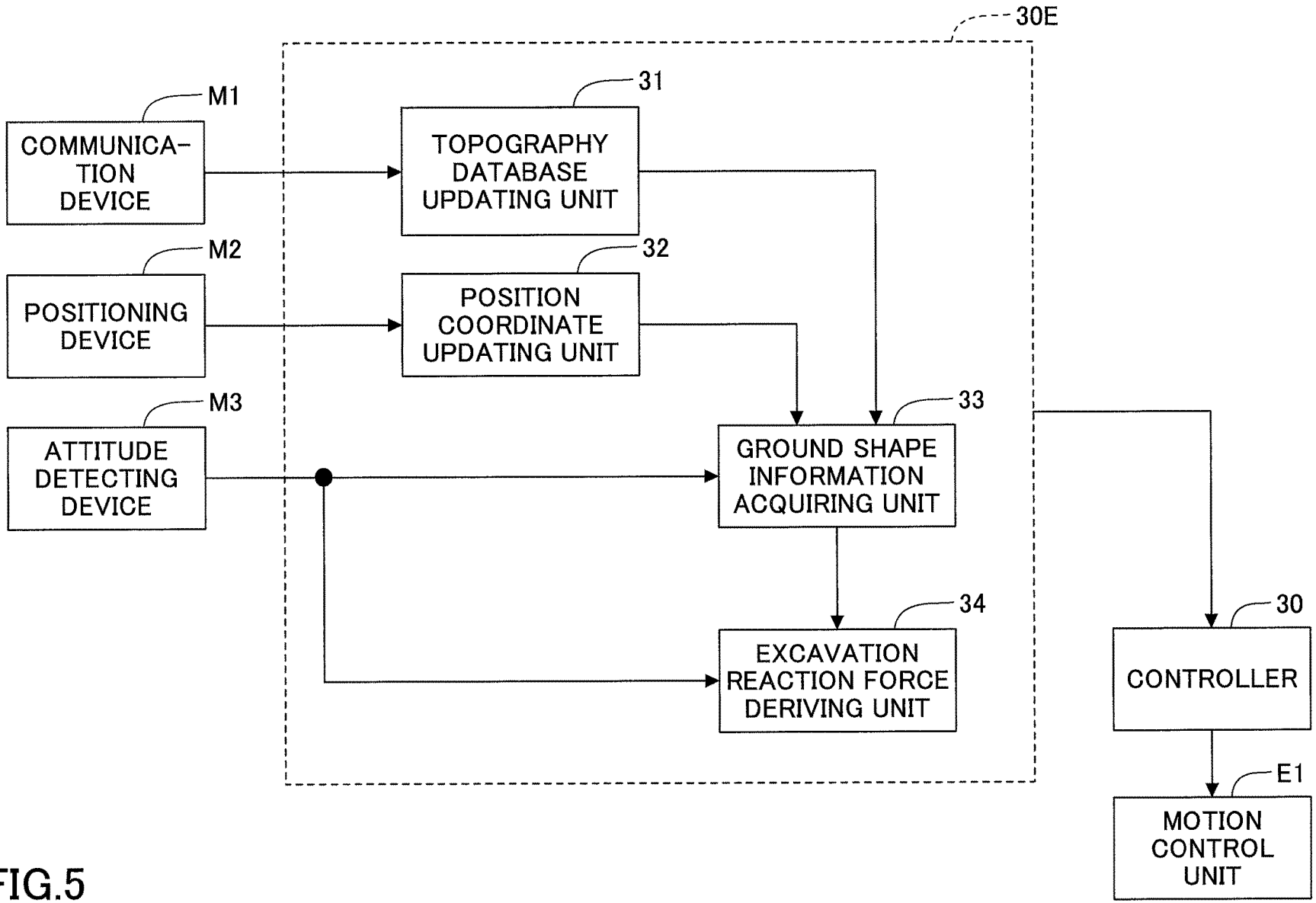
FIG. 5 is a functional block diagram illustrating a configuration example of an external computing device.

Next, the functions of the external computing device 30E will be described with reference to FIG. 5. FIG. 5 is a functional block diagram illustrating a configuration example of the external computing device 30E. In the present embodiment, the external computing device 30E receives various outputs from the communication device M1, the positioning device M2, and the attitude detecting device M3, executes various computations, and outputs the computation result to the controller 30. The controller 30 outputs, for example, a control instruction corresponding to the calculation result, to a motion control unit E1.

The motion control unit E1 is a functional element for controlling the motion of the attachment, and includes, for example, the pilot pressure adjusting device 50 and the flow rate control valves 171 to 176, etc. In the case where the flow rate control valves 171 to 176 operate in accordance with electric signals, the controller 30 directly transmits the electric signals to the flow rate control valves 171 to 176.

The motion control unit E1 may include an information notification device for notifying the operator of the excavator that the motion of the attachment has been automatically adjusted. The information notification device includes, for example, a sound output device and an LED lamp, etc.

Specifically, the external computing device 30E mainly includes a topography database updating unit 31, a position coordinate updating unit 32, a ground shape information acquiring unit 33, and an excavation reaction force deriving unit 34.

The topography database updating unit 31 is a functional element for updating the topography database that systematically stores the topography information of the work site, so as to be referable. In the present embodiment, the topography database updating unit 31 acquires the topography information of the work site through the communication device M1, for example, when the excavator is activated, and updates the topography database. The topography database is stored in a nonvolatile memory, etc. Furthermore, the topography information of the work site is described by, for example, a three-dimensional topography model based on the world positioning system. The topography database updating unit 31 may acquire the topography information of the work site and update the topography database based on the images of the surroundings of the excavator, captured by the imaging device M5.

The position coordinate updating unit 32 is a functional element for updating the coordinates and the orientation indicating the present position of the excavator. In the present embodiment, the position coordinate updating unit 32 acquires the position coordinates and the orientation of the excavator in the world positioning system based on the output of the positioning device M2, and updates the data relating to the coordinates and the orientation representing the present position of the excavator stored in the nonvolatile memory, etc.

The ground shape information acquiring unit 33 is a functional element for acquiring information relating to the present shape of the ground of the work target. In the present embodiment, the ground shape information acquiring unit 33 acquires information relating to the present shape of the ground to be excavated (excavation ground), based on the topography information updated by the topography database updating unit 31, the coordinates and the orientation indicating the present position of the excavator updated by the position coordinate updating unit 32, and the past transition of the attitude of the excavator attachment that has been detected by the attitude detecting device M3. Furthermore, the ground shape information acquiring unit 33 may acquire information relating to the present shape of the excavation ground, by using the topography information of the work site acquired based on images of the surroundings of the excavator captured by the imaging device M5, without using the information relating to the transition in the attitude of the excavator attachment detected by the attitude detecting device M3. Furthermore, the information relating to the transition of the attitude of the excavator attachment detected by the attitude detecting device M3 and the information relating to the ground shape based on images captured by the imaging device M5, may be used in combination. In this case, by using the information relating to the transition of the attitude of the excavator attachment detected by the attitude detecting device M3 during work, and by using the information relating to the ground shape based on images captured by the imaging device M5 at predetermined timings, it is possible to modify the information derived from the attitude detecting device M3, with the information derived from the imaging device M5.

Figure 6:
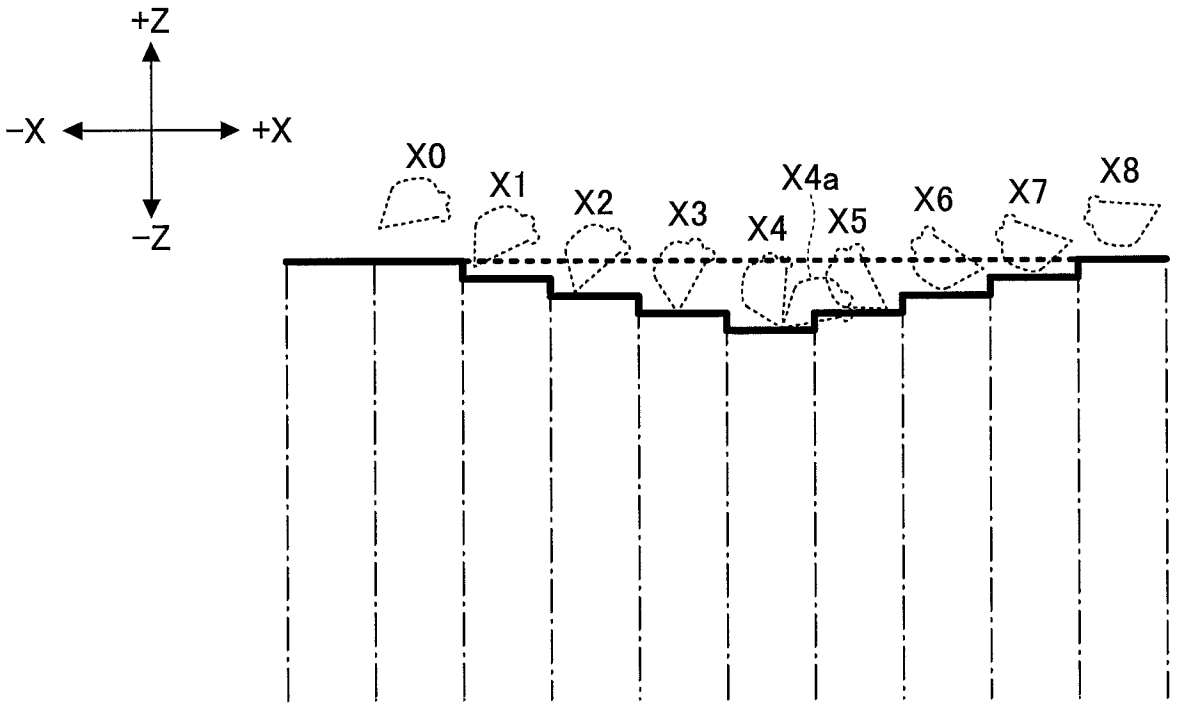
FIG. 6 is a conceptual diagram of information relating to the present shape of the excavation ground acquired by a ground shape information acquiring unit.

Here, with reference to FIG. 6, a process in which the ground shape information acquiring unit 33 acquires information relating to the ground shape after an excavation operation, will be described. FIG. 6 is a conceptual diagram of information relating to the ground shape after an excavation operation. A plurality of bucket shapes X0 to X8 indicated by broken lines in FIG. 6, represent the trajectory of the bucket 6 in a previous excavation operation. The trajectory of the bucket 6 is derived from the transition in the attitude of the excavator attachment, detected by the attitude detecting device M3 in the past. Furthermore, thick solid lines in FIG. 6 represent the present cross-sectional shape of the excavation ground recognized by the ground shape information acquiring unit 33, and the thick dotted lines represent a cross-sectional shape of the excavation ground before the previous excavation operation has been performed, recognized by the ground shape information acquiring unit 33. That is, the ground shape information acquiring unit 33 removes a part corresponding to the space through which the bucket 6 has passed during the previous excavation operation, from the shape of the excavation ground before the previous excavation operation is performed, thereby deriving the present shape of the excavation ground. In this way, the ground shape information acquiring unit 33 can estimate the ground shape after an excavation operation. Each of the blocks extending in the Z-axis direction indicated by chain lines in FIG. 6 represents each element of the three-dimensional topography model. Each element is represented by a model having, for example, an upper surface of the unit area parallel to the XY plane and an infinite length in the −Z direction. The three-dimensional topographical model may be represented by a three-dimensional mesh model.

The excavation reaction force deriving unit 34 is a functional element for deriving the excavation reaction force. The excavation reaction force deriving unit 34 derives the excavation reaction force based on, for example, the attitude of the excavator attachment and information relating to the present shape of the excavation ground. The attitude of the excavator attachment is detected by the attitude detecting device M3 and the information relating to the present shape of the excavation ground is acquired by the ground shape information acquiring unit 33. Furthermore, as described above, the ground shape information acquiring unit 33 may acquire information relating to the present shape of the excavation ground, by using the topography information of the work site acquired based on images of the surroundings of the excavator captured by the imaging device M5. Furthermore, the excavation reaction force deriving unit 34 may use a combination of information relating to the transition of the attitude of the excavator attachment detected by the attitude detecting device M3 and information relating to the ground shape based on the images captured by the imaging device M5.

In the present embodiment, the excavation reaction force deriving unit 34 derives the excavation reaction force at a predetermined calculation cycle, using a predetermined calculation formula. For example, the excavation reaction force is derived so that the excavation reaction force increases as the excavation depth increases; that is, as the vertical distance between the ground contact surface of the excavator and the bucket toe position P4 (see FIG. 2) increases. Furthermore, for example, the excavation reaction force deriving unit 34 derives the excavation reaction force so that the excavation reaction force increases as the ground insertion depth of the toe of the bucket 6 with respect to the excavation ground, increases. The excavation reaction force deriving unit 34 may derive the excavation reaction force in consideration of sediment characteristics such as the sediment density. The sediment characteristic may foe a value input by an operator through an in-vehicle input device (not illustrated), or may be a value automatically calculated based on outputs of various sensors such as a cylinder pressure sensor.

The excavation reaction force deriving unit 34 may determine whether excavation is being performed, based on the attitude of the excavator attachment and information relating to the present shape of the excavation ground, and output the determination result to the controller 30. The excavation reaction force deriving unit 34 determines that excavation is being performed, for example, when the vertical distance between the bucket toe position P4 (see FIG. 2.) and the excavation ground becomes less than or equal to a predetermined value. The excavation reaction force deriving unit 34 may determine that excavation is being performed before the toe of the bucket 6 contacts the excavation ground.

When it is determined by the excavation reaction force deriving unit 34 that excavation is being performed, the controller 30 determines the present excavation stage based on the operation content of the operator. The controller 30 itself may determine whether excavation is being performed based on the attitude of the excavator attachment and information relating to the present shape of the excavation ground. In the present embodiment, the controller 30 determines the present excavation stage based on the operation content output from the operation device 26.

Furthermore, the controller 30 calculates the bucket toe angle α based on the output of the attitude detecting device M3 and the information relating to the present shape of the excavation ground. The bucket toe angle α is an angle of the toe of the bucket 6 with respect to the excavation ground.

Figure 7A:
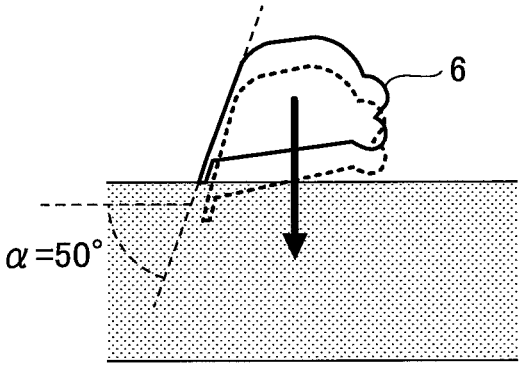
FIG. 7A is a diagram for describing an initial stage of excavation.
Figure 7B:
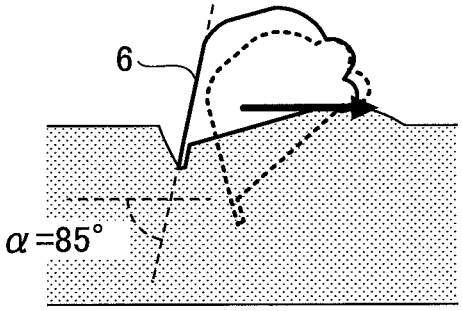
FIG. 7B is a diagram for describing a middle stage of excavation.
Figure 7C:
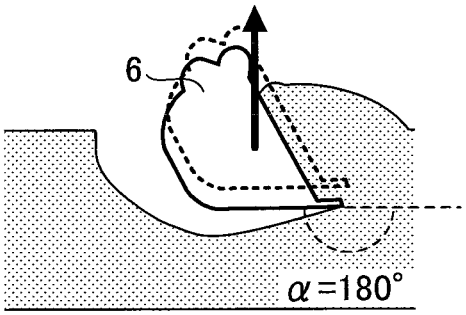
FIG. 7C is a diagram for describing a latter stage of excavation.

Here, with reference to FIGS. 7A to 7C, the excavation stages including three stages of an initial stage of excavation, a middle stage of excavation, and a latter stage of excavation will be described. FIGS. 7A to 7C are diagrams for describing the excavation stages; FIG. 7A illustrates the relationship between the bucket 6 and the excavation ground during the initial stage of excavation, and FIG. 7B illustrates the relationship between the bucket 6 and the excavation ground during the middle stage of excavation, and FIG. 7C illustrates the relationship between the bucket 6 and the excavation ground in the latter stage of excavation.

The initial stage of excavation means a stage in which the bucket 6 is moved vertically downward as indicated by the arrow in FIG. 7A. Therefore, the excavation reaction force in the initial stage of excavation is mainly composed of the insertion resistance when the toe of the bucket 6 is inserted into the excavation ground, and mainly faces vertically upward. The insertion resistance is proportional to the insertion depth of the toe of the bucket 6 in the ground. Furthermore, the insertion resistance becomes minimum when the bucket toe angle α is substantially 90 degrees, if the ground insertion depth of the toe of the bucket 6 is the same. For example, when the controller 30 determines that the boom lowering operation is being performed during excavation, the controller 30 adopts the initial stage of excavation as the present excavation stage.

The middle stage of excavation means a stage of drawing the bucket 6 toward the body side of the excavator, as indicated by an arrow in FIG. 7B. For this reason, the excavation reaction force in the middle stage of excavation is mainly composed of the shear resisting force against the sliding fracture in the excavation ground, and mainly faces away from the body of the excavator. For example, when the controller 30 determines that an arm closing operation is being performed during excavation, the controller 30 adopts the middle stage of excavation as the present excavation stage. Alternatively, when the controller 30 determines that the boom lowering operation is not being performed and an arm closing operation is performed during the excavation, the controller 30 may adopt the middle stage of excavation as the present excavation stage. A reference numeral X4*a* in FIG. 6 indicates the shape of the bucket 6 drawn toward the body side of the excavator in a state where the bucket toe angle α is 50 degrees in the middle stage of excavation.

The excavation reaction force in the middle stage of excavation increases as the bucket toe angle α decreases, because a sliding fracture of the excavation ground will hardly occur. On the contrary, the excavation reaction force in the middle stage of excavation decreases as the bucket toe angle α increases, because a sliding fracture in the excavation ground is more likely to occur. When the bucket toe angle α is larger than 90 degrees, the excavation amount decreases as the bucket toe angle α increases.

Figure 8:
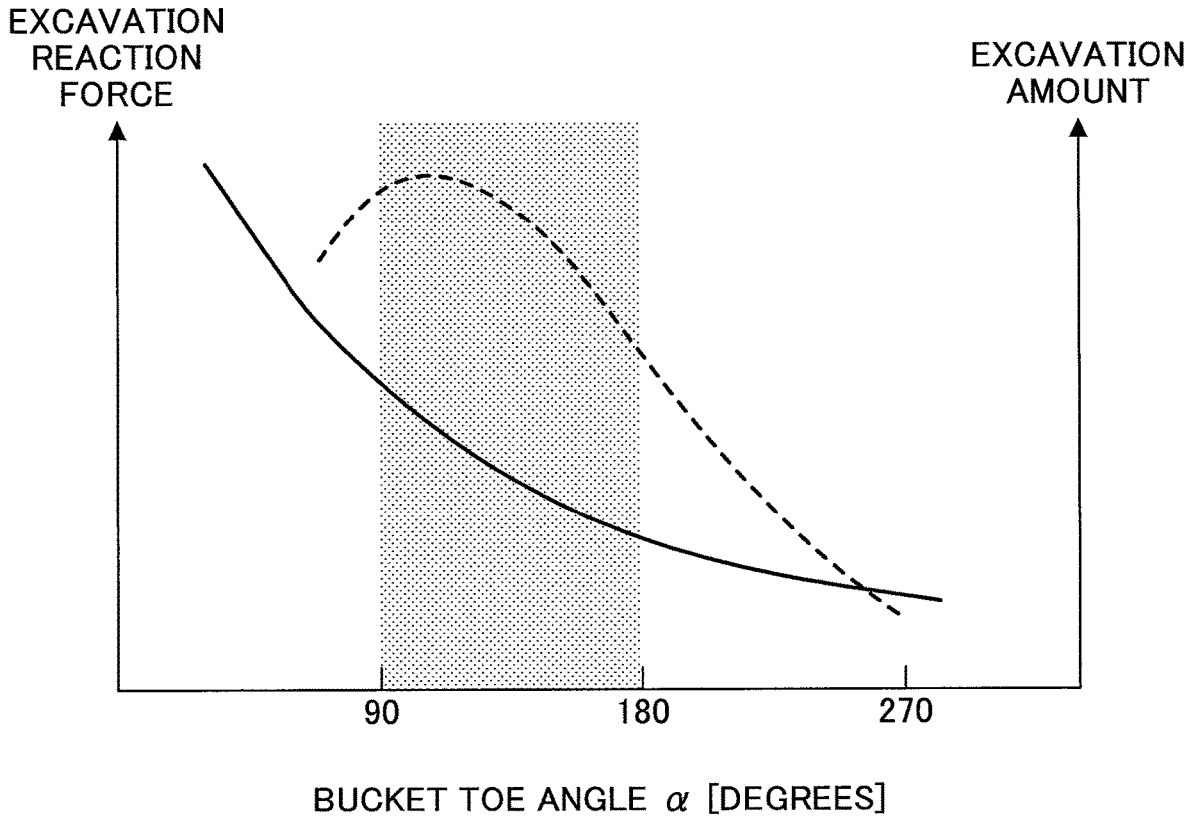
FIG. 8 a diagram illustrating the relationship between a bucket toe angle, an excavation reaction force, and an excavation amount, in the middle stage of excavation.

FIG. 8 illustrates an example of the relationship between the bucket toe angle α, the excavation reaction force, and the excavation amount, in the middle stage of excavation. Specifically, the horizontal axis corresponds to the bucket toe angle α, the first vertical axis on the left side corresponds to the excavation reaction force, and the second vertical axis on the right side corresponds to the excavation amount. The excavation amount in FIG. 8 represents the excavation amount when excavation is performed at a predetermined depth and a predetermined drawing distance, in a state where the bucket toe angle α is maintained at an any angle. The transition of the excavation reaction force is represented by a solid line, and the transition of the excavation amount is represented by a broken line. In the example of FIG. 8, the excavation reaction force in the middle stage of excavation is increases as the bucket toe angle α decreases. The excavation amount becomes the maximum value when the bucket toe angle α is around 100°, and the excavation amount decreases as the bucket toe angle α departs from around 100°. The range of the bucket toe angle α indicated by a dot pattern in FIG. 8 (a range of greater than or equal to 90° and less than or equal to 180°) is an example of the range of the bucket toe angle α suitable for the middle stage of excavation, providing an appropriate balance between excavation reaction force and the excavation amount. The same tendency is also indicated when shifting from the initial stage of excavation to the middle stage of excavation.

The latter stage of excavation means a stage of raising the bucket 6 vertically upward as indicated by an arrow in FIG. 7C. Therefore, the excavation reaction force in the latter stage of excavation is mainly composed of the weight of earth and sand, etc., taken into the bucket 6, and mainly faces vertically downward. For example, when the controller 30 determines that a boom raising operation is being performed daring excavation, the controller 30 adopts the latter stage of excavation as the present excavation stage. Alternatively, when the controller 30 determines that an arm closing operation is not being performed and that a boom raising operation is being performed during the excavation, the controller 30 may adopt the latter stage of excavation as the present excavation stage.

Furthermore, the controller 30 determines whether to execute control for automatically adjusting the attitude of the bucket 6 (hereinafter referred to as "bucket attitude control"), based on at least one of the bucket toe angle α and the excavation reaction force, and the present excavation stage.

Furthermore, the controller 30 determines whether to execute control for automatically raising the boom 4 (hereinafter referred to as "boom raising control"), based on the excavation reaction force in the middle stage of excavation. In the present embodiment, the controller 30 executes the boom raising control when the excavation reaction force derived by the excavation reaction force deriving unit 34 is greater than or equal to a predetermined value.

Figure 9:
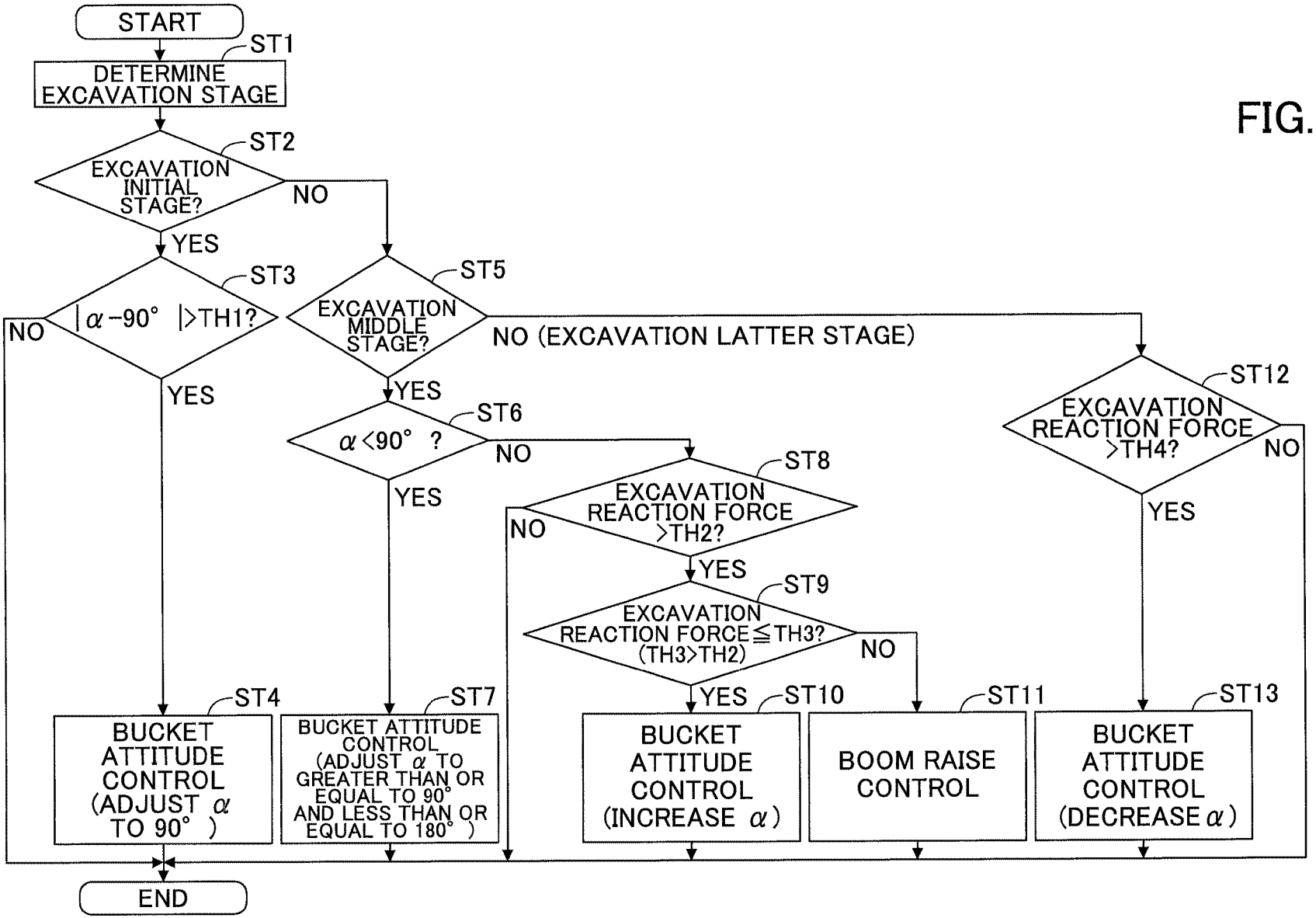
FIG. 9 is a flowchart illustrating the flow of a bucket attitude adjustment process.

Next, with reference to FIG. 9, a flow of a process for selectively executing bucket attitude control (hereinafter referred to as "bucket attitude adjustment process") will be described. FIG. 9 is a flowchart illustrating the flow of the bucket attitude adjustment process. When it is determined by the excavation reaction force deriving unit 34 that excavation is being performed, the controller 30 repeatedly executes this bucket attitude adjustment process at a predetermined cycle.

First, the controller 30 determines the excavation stage (step ST1). In the present embodiment, the controller 30 determines the present excavation stage based on the operation content output from the operation device 26.

Subsequently, the controller 30 determines whether the present excavation stage is the initial stage of excavation (step ST2). In the present embodiment, when the controller 30 determines that the boom lowering operation is being performed, the controller 30 determines that the present excavation stage is the initial stage of excavation.

When it is determined that the excavation is in the initial stage (YES in step ST2), the controller 30 determines whether the angle difference (absolute value) between the present bucket toe angle α and the initial target angle (for example, 90 degrees) is larger than a predetermined threshold value TH1 (step ST3). The initial target angle may be registered in advance or may be dynamically calculated based on various kinds of information.

When it is determined that the angular difference is less than or equal to the threshold value TH1 (NO in step ST3), the controller 30 terminates the present bucket attitude adjustment process without executing the bucket attitude control, and continues the execution of the normal control. That is, the driving of the excavator attachment according to the lever operation amounts of various operation levers, is continued.

On the other hand, when it is determined that the angular difference is greater than the threshold value TH1 (YES in step ST3), the controller 30 executes bucket attitude control (step ST4). Here, the controller 30 adjusts the control current with respect to the pilot pressure adjusting device 50 as the motion control unit E1, and adjusts the pilot pressure acting on the pilot port of the flow rate control valve 174 related to the bucket cylinder 9. Then, the controller 30 automatically opens and closes the bucket 6 so that the bucket toe angle α is the initial target angle (for example, 90 degrees).

For example, as illustrated in FIG. 7A, when the bucket toe angle α is 50 degrees immediately before the toe of the bucket 6 contacts the excavation ground, the controller 30 determines that the angular difference (40 degrees) from the initial target angle (90 degrees) is larger than the threshold TH1. Then, the controller 30 adjusts the control current with respect to the pilot pressure adjusting device 50, to automatically close the bucket 6, so that the bucket toe angle α is the initial target angle (90 degrees).

By this bucket attitude control, the controller 30 can always adjust the bucket toe angle α when the bucket 6 contacts the excavation ground, at an angle (approximately 90 degrees) suitable for the initial stage of excavation. As a result, the insertion resistance can be reduced and the excavation reaction force can be reduced.

In step ST2, when it is determined that the excavation is not in the initial stage (NO in step ST2), the controller 30 determines whether the present excavation stage is the middle stage of excavation (step ST5). In the present embodiment, when the controller 30 determines that the arm closing operation is performed, the controller 30 determines that the present excavation stage is the middle stage of excavation.

When it is determined that the excavation is in the middle stage (YES in step ST5), the controller 30 determines whether the bucket toe angle α is less than the allowable minimum angle (for example, 90 degrees) (step ST6). Note that the allowable minimum angle may be registered in advance or may be dynamically calculated based on various kinds of information.

When it is determined that the bucket toe angle α is less than the allowable minimum angle (90 degrees) (YES in step ST6), the controller 30 determines that there is a possibility that the excavation reaction force may become excessively high, and executes bucket attitude control (step ST7). Here, the controller 30 adjusts the control current with respect to the pilot pressure adjusting device 50, and adjusts the pilot pressure acting on the pilot port of the flow rate control valve 174. Then, the controller 30 automatically closes the bucket 6 so that the bucket toe angle α is an angle suitable for the middle stage of excavation (for example, an angle of greater than or equal to 90 degrees and less than or equal to 180 degrees). The angle suitable for the middle stage of excavation may be registered in advance or may be dynamically calculated based on various kinds of information. The controller 30 may use a middle target angle as an angle suitable for the middle stage of excavation, instead of the allowable minimum angle. Then, instead of determining whether the angle is less than the allowable minimum angle, it may be determined whether the angular difference (absolute value) between the present bucket toe angle α and the middle target angle is larger than a predetermined threshold value. When it is determined that the angular difference is larger than the predetermined threshold value, the bucket 6 is automatically opened and closed so that the bucket toe angle α becomes the middle target angle. The middle target angle may be registered in advance or may be dynamically calculated based on various kinds of information.

For example, as illustrated in FIG. 7B, when the bucket toe angle α is 85 degrees immediately before drawing the bucket 6 to the body side of the excavator, the controller 30 determines that the bucket toe angle α is less than the allowable minimum angle (90 degrees). Then, the controller 30 adjusts the control current with respect to the pilot pressure adjusting device 50 to automatically close the bucket 6 so that the bucket toe angle α is an angle (for example, 100 degrees) suitable for the middle stage of excavation.

By this bucket attitude control, the controller 30 can always adjust the bucket toe angle α in the middle stage of excavation, to an angle suitable for the middle stage of excavation (an angle of greater than or equal to 90 degrees and less than or equal to 180 degrees). As a result, it is possible to avoid a decrease in the excavation amount while reducing the excavation reaction force.

On the other hand, when it is determined that the bucket toe angle α is greater than or equal to the allowable minimum angle (90 degrees) (NO in step ST6), the controller 30 determines whether the excavation reaction force is higher than a predetermined threshold value TH2 (step ST8). In the present embodiment, the controller 30 determines whether the excavation reaction force derived by the excavation reaction force deriving unit 34 is higher than the threshold value TH2. The controller 30 may calculate the excavation reaction force based on the pressure of the hydraulic oil in the bottom side oil chamber of the arm cylinder 8 (hereinafter referred to as "arm bottom pressure"), and the pressure of the hydraulic oil in the bottom side oil chamber of the bucket cylinder 9 (hereinafter referred to as "bucket bottom pressure), etc.

When it is determined that the excavation reaction force is less than or equal to the threshold value TH2 (NO in step ST8), the controller 30 terminates the present bucket attitude adjustment process without executing the bucket attitude control, and continues the execution of the normal control. This is because it can be determined that the excavation work can be continued at the present bucket toe angle α.

When it is determined that the excavation reaction force is higher than the threshold value TH2 (YES in step ST8), the controller 30 determines whether the excavation reaction force is less than or equal to a predetermined threshold TH3 (>TH 2) (step ST9).

When it is determined that the excavation reaction force is less than or equal to the threshold value TH3 (YES in step ST9), the controller 30 determines that there is a possibility that the excavation work cannot be continued at the present bucket toe angle α, and executes bucket attitude control (step ST10). Here, the controller 30 adjusts the control current with respect to the pilot pressure adjusting device 50, and adjusts the pilot pressure acting on the pilot port of the flow rate control valve 174. Then, the controller 30 automatically closes the bucket 6 so that the excavation reaction force becomes less than or equal to the threshold value TH2, and increases the bucket toe angle α. This is to make sliding fracture of the excavation ground easier to occur, and reduce excavation reaction force.

On the other hand, when it is determined that the excavation reaction force is higher than the threshold TH3 (NO in step ST9), the controller 30 determines that there is a possibility that the excavation work cannot be continued even if the bucket attitude control is executed, and executes boom raising control (step ST11). Here, the controller 30 adjusts the control current with respect to the pilot pressure adjusting device 50, and adjusts the pilot pressure acting on the pilot port of the flow rate control valve 176 related to the boom cylinder 7. Then, the controller 30 automatically raises the boom 4 so that the excavation reaction force becomes less than or equal to the threshold value TH3.

In step ST5, when it is determined that the excavation is not in the middle stage (NO in step ST5), the controller 30 determines that the present excavation stage is the latter stage of excavation. When it is determined that the boom raising operation is being performed, the controller 30 may determine that the present excavation stage is the latter stage of excavation.

Then, the controller 30 determines whether the excavation reaction force is higher than a predetermined threshold TH4 (step ST12).

When it is determined that the excavation reaction force is less than or equal to the threshold value TH4 (NO in step ST12), the controller 30 terminates the present bucket attitude adjustment process without executing the bucket attitude control and continues the execution of the normal control. This is because it can be determined that the excavation work can be continued at the present bucket toe angle α.

On the other hand, when it is determined that the excavation reaction force is higher than the threshold value TH4 (YES in step ST12), the controller 30 determines that the bucket 6 cannot be raised, and executes bucket attitude control (step ST13). Here, the controller 30 adjusts the control current with respect to the pilot pressure adjusting device 50 and adjusts the pilot pressure acting on the pilot port of the flow rate control valve 174. Then, the controller 30 automatically opens the bucket 6 so that the excavation reaction force is less than or equal to the threshold value TH4 to reduce the bucket toe angle α. This is to reduce the weight of earth and sand, etc., taken into the bucket 6.

For example, as illustrated in FIG. 7C, when the bucket toe angle α is 180 degrees immediately before raising the bucket 6 in the vertical upward direction, the controller 30 adjusts the control current with respect to the pilot pressure adjusting device 50, to automatically open the bucket 6. This is for reducing the bucket toe angle α so that the excavation reaction force is less than or equal to the threshold value TH4.

With such a process flow, the controller 30 supports the excavation work in a form of assisting the lever operation by the operator, and it is possible to avoid a decrease in the excavation amount while reducing the excavation reaction force.

For example, the controller 30 can prevent the initial stage of excavation from being started while the bucket toe angle α is significantly deviating from the initial target angle, and prevent the excavation reaction force from becoming excessively high in the initial stage of excavation.

Furthermore, the controller 30 can prevent the middle stage of excavation from being performed while the bucket toe angle α is significantly deviating from the angular range suitable for the middle stage of excavation, and prevent the excavation reaction force from becoming excessively high in the middle stage of excavation. Furthermore, it is possible to prevent the excavation amount from being excessively reduced.

Furthermore, the controller 30 can prevent the latter stage of excavation from being performed while the weight of earth and sand, etc., in the bucket 6 is excessively high, and to prevent the excavation reaction force from becoming excessively high in the latter stage of excavation.

Furthermore, the controller 30 repeatedly executes this bucket attitude adjustment process at a predetermined cycle during excavation; the controller 30 may execute this bucket attitude adjustment process only at predetermined timings including the start of the Initial stage of excavation, the start of the middle stage of excavation, and the start of the latter stage of excavation.

Next, with reference to FIGS. 10 to 17, an excavator mechanical shovel) capable of more appropriately controlling the excavator attachment will be described.

In the related art, there is known an excavator that calculates an acting: force for rotating the bucket based on the pressure of hydraulic oil in the bucket cylinder, and that calculates the excavation moment based on the acting force.

In this excavator, the expansion and contraction of the bucket cylinder and the boom cylinder is automatically controlled according to the change in the calculated excavation moment, to reduce the excavation moment as compared to the case of manual operation.

However, the excavator of the related art merely calculates the excavation moment based on the pressure of the hydraulic oil in the bucket cylinder, and consideration is not given to the moment of inertia of the excavator attachment that varies according to the attitude of the excavator attachment (the moment that does not contribute to the actual excavating, among the excavation moment). Therefore, the excavation moment calculated by the excavator of the related art may be deviated from the actual excavation moment, and expansion and contraction of the bucket cylinder and the boom cylinder may not be appropriately controlled.

In view of the above, it is desirable to provide an excavator that can more appropriately control the excavator attachment.

Figure 10:
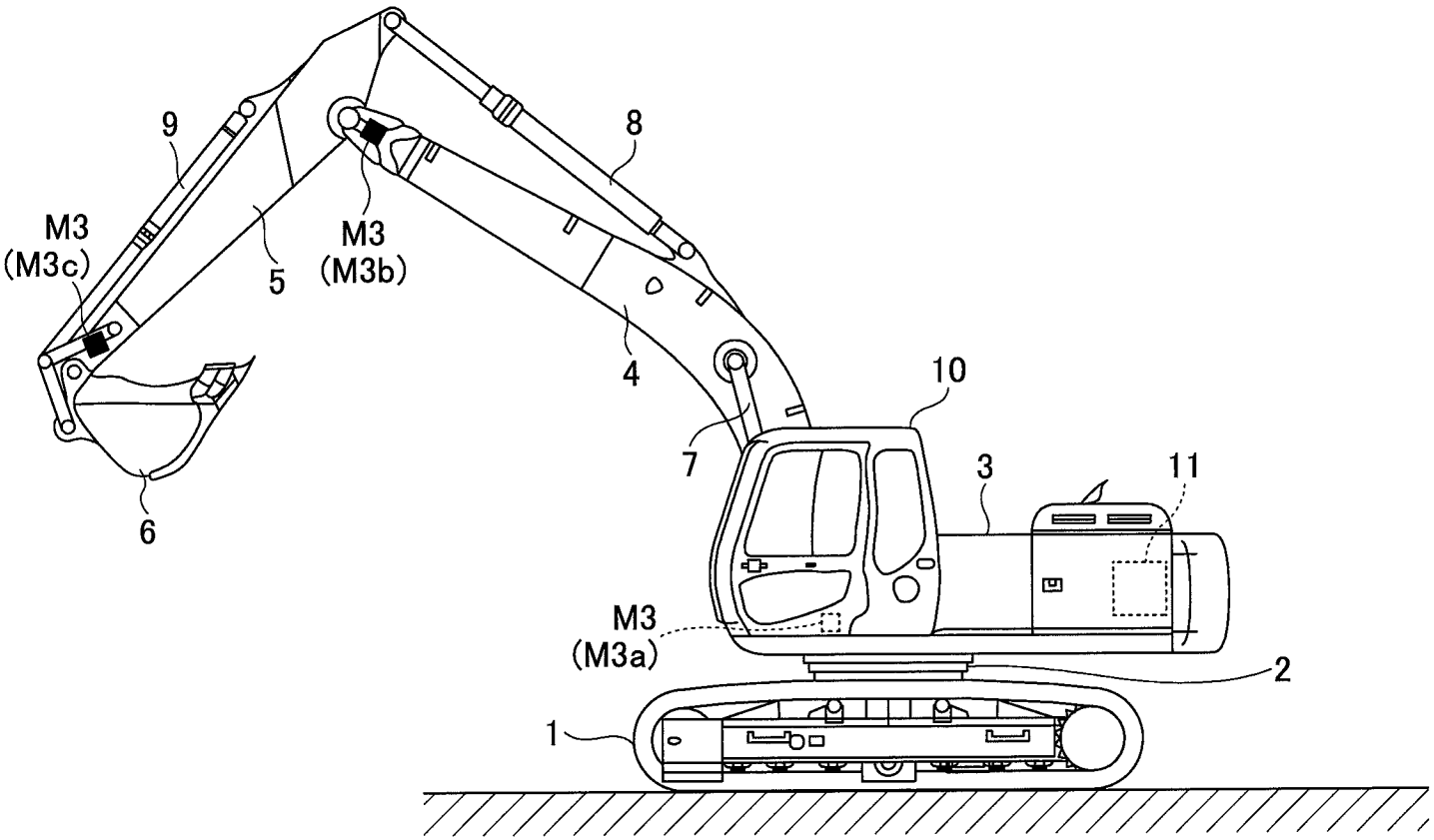
FIG. 10 is a side view of an excavator according to an embodiment of the present invention.

FIG. 10 is a side view of an excavator according to an embodiment of the present invention. The upper turning body 3 is turnably mounted, on the lower traveling body 1 of the excavator illustrated in FIG. 10 via the turning mechanism 2. The boom 4 is attached to the upper turning body 3. The arm 5 is attached to the front end of the boom 4, and the bucket 6 is attached to the tip of the arm 5. The boom 4, the arm 5, and the bucket 6, as working elements, constitute the excavator attachment that is an example of an attachment. The boom 4, the arm 5, and the bucket 6 are hydraulically driven by the boom cylinder 7, the arm cylinder 8, and the bucket cylinder 9, respectively. On the upper turning body 3, the cabin 10 is provided, and a power source such as the engine 11 is installed.

The attitude detecting device M3 is attached to the excavator attachment. The attitude detecting device M3 detects the attitude of the excavator attachment. In the present embodiment, the attitude detecting device M3 includes the boom angle sensor M3*a*, the arm angle sensor M3*b*, and the bucket angle sensor M3*c*.

The boom angle sensor M3*a* is a sensor for acquiring the boom angle and includes, for example, a rotation angle sensor for detecting the rotation angle of the boom foot pin, a stroke sensor for detecting the stroke amount of the boom cylinder 7, and an inclination (acceleration) sensor for detecting the inclination angle of the boom 4, etc. The same applies to the arm angle sensor M3*b* and the bucket angle sensor M3*c*.

Figure 11:
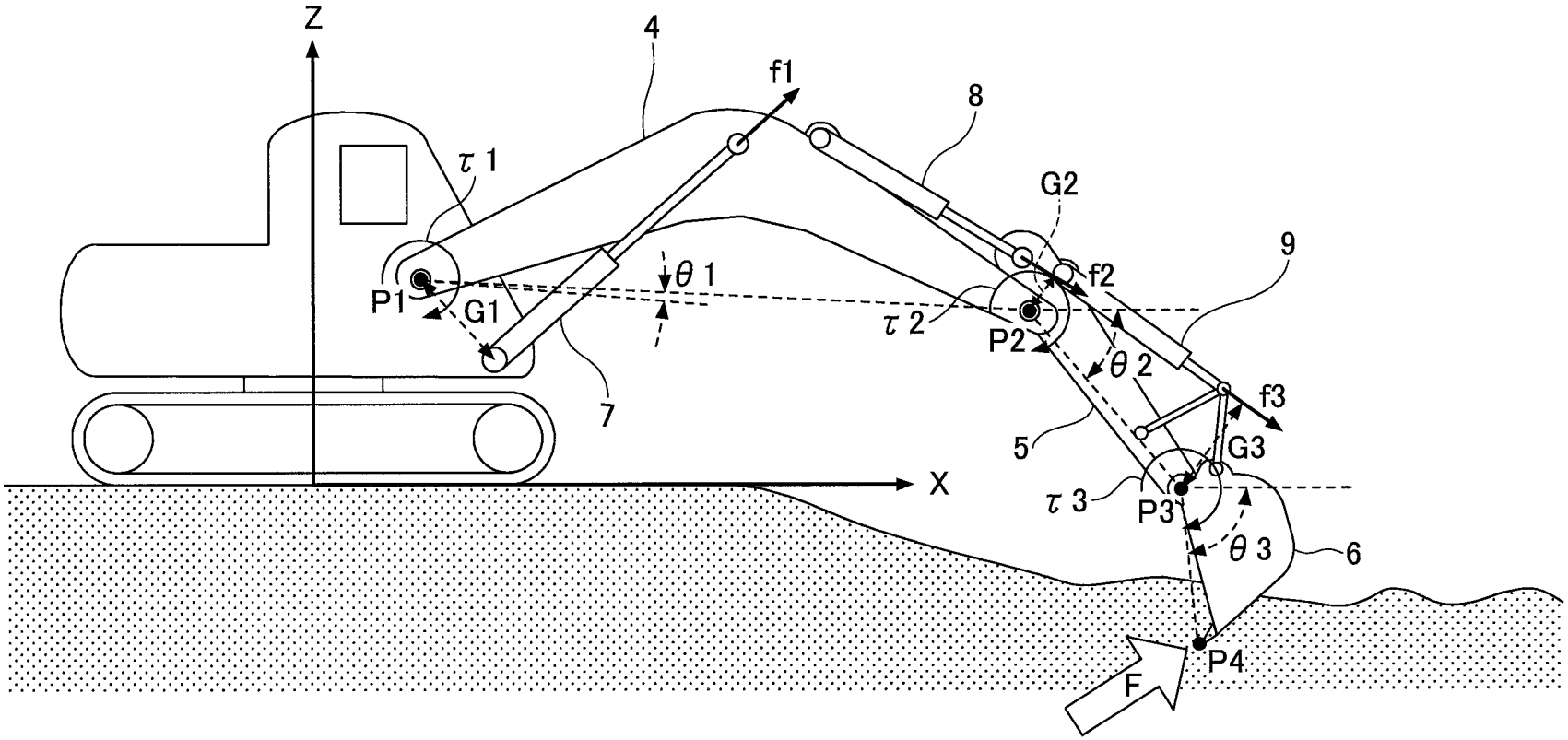
FIG. 11 is a side view of the excavator, illustrating various physical quantities related to an excavator attachment of the excavator of FIG. 10.

FIG. 11 is a side view of the excavator, Illustrating various physical quantities related to the excavator attachment. The boom angle sensor M3*a* acquires, for example, the boom angle (θ1). The boom angle (θ1) is an angle of a line segment P1-P2 connecting the boom foot pin position P1 and the arm connecting pin position P2, with respect to the horizontal line, in the XZ plane. The arm angle sensor M3*b* acquires, for example, the arm angle (θ2). The arm angle (θ2) is an angle of the line segment P2-P3 connecting the arm connecting pin position P2 and the bucket connecting pin position P3, with respect to the horizontal line, on the XZ plane. The bucket angle sensor M3*c* acquires, for example, the bucket angle (θ3). The bucket angle (θ3) is the angle of the line segment P3-P4 connecting the bucket connecting pin position P3 and the bucket toe position P4, with respect to the horizontal line, on the XZ plane.

Figure 12:
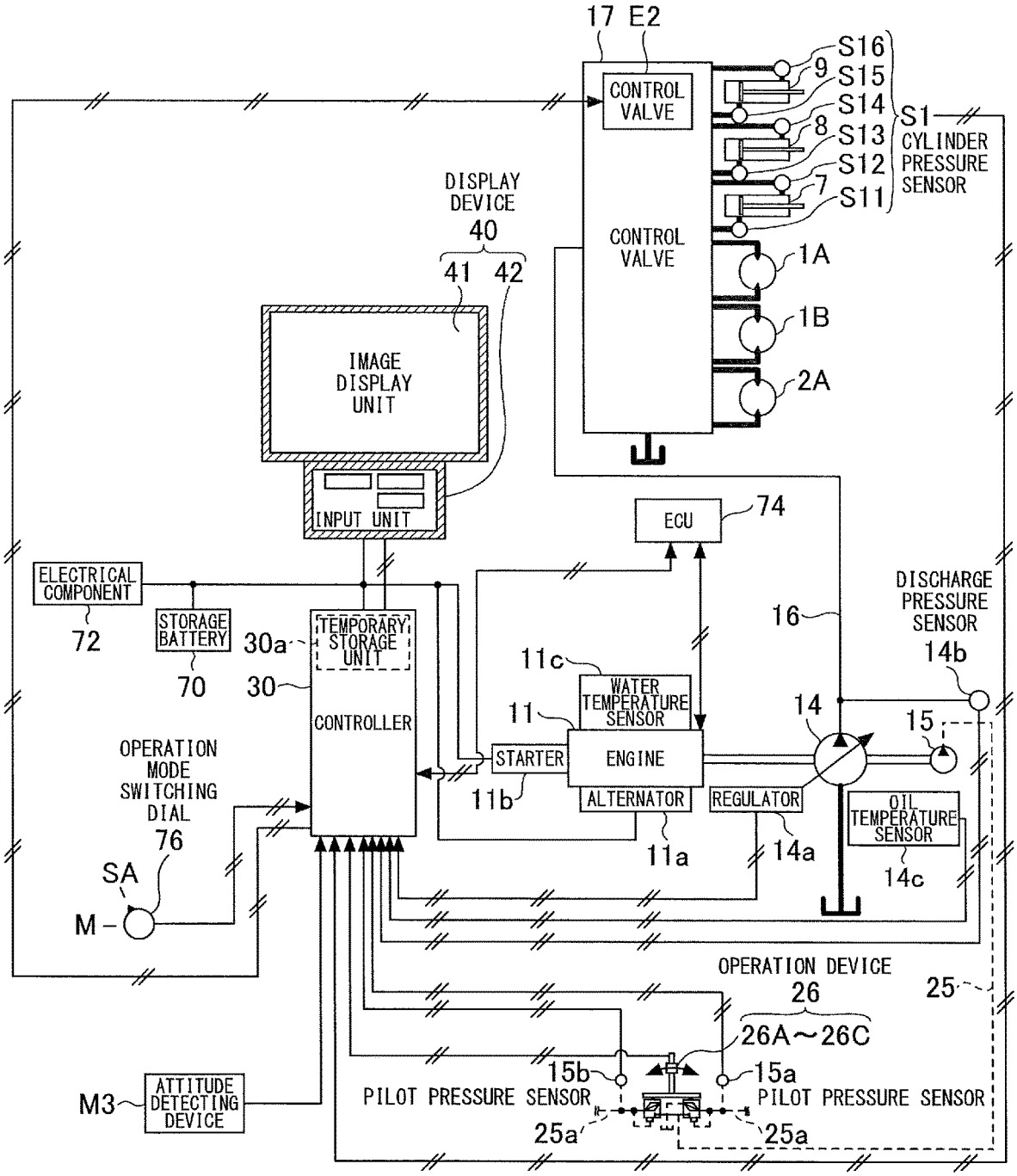
FIG. 12 is a diagram illustrating a configuration example of a basic system installed in the excavator of FIG. 10.

Next, the basic system of the excavator will be described with reference to FIG. 12. The basic system of the excavator mainly includes the engine 11, the main pump 14, the pilot pump 15, the control valve 17, the operation device 26, the controller 30, and the engine control device (ECU) 74, etc.

The engine 11 is a driving source of the excavator, and is, for example, a diesel engine operating to maintain a predetermined revolution speed. An output shaft of the engine 11 is connected to input shafts of the main pump 14 and the pilot pump 15.

The main pump 14 is a hydraulic pump that supplies hydraulic oil to the control valve 17 via a high-pressure hydraulic line 16, and is, for example, a swash plate type variable capacity hydraulic pump. In the swash plate type variable capacity hydraulic pump, the stroke length of the piston determining the displacement volume, changes according to the change in the swash plate tilt angle, and the discharge flow rate per rotation changes. The swash plate tilt angle is controlled by the regulator 14*a*. The regulator 14*a* changes the swash plate tilt angle according to the change in the control current from the controller 30. For example, the regulator 14*a* increases the swash plate tilt angle according to the increase of the control current to increase the discharge flow rate of the main pump 14. Alternatively, the regulator 14*a* decreases the swash plate tilt angle according to the decrease of the control current, and reduces the discharge flow rate of the main pump 14. The discharge pressure sensor 14*b* detects the discharge pressure of the main pump 14. The oil temperature sensor 14*c* detects the temperature of the hydraulic oil sucked by the main pump 14.

The pilot pump 15 is a hydraulic pump for supplying hydraulic oil to various hydraulic control devices such as the operation device 26 via the pilot line 25, and is, for example, a fixed capacity hydraulic pump.

The control valve 17 is a set of flow rate control valves for controlling the flow of the hydraulic oil relating to the hydraulic actuator. The control valve 17 operates in accordance with changes in the pressure of the hydraulic oil in the pilot line 25*a* corresponding to the operation direction and the operation amount of the operation device 26. The control valve 17 selectively supplies the hydraulic oil received from the main pump 14 via the high-pressure hydraulic line 16, to one or more hydraulic actuators. The hydraulic actuator includes, for example, the boom cylinder 7, the arm cylinder 8, the bucket cylinder 9, the left traveling hydraulic motor 1A, the right traveling hydraulic motor 1B, and the turning hydraulic motor 2A, etc.

The operation device 26 is a device used by the operator for operating the hydraulic actuator, and includes the lever 26A, the lever 26B, and the pedal 26C, etc. The operation device 26 receives the supply of hydraulic oil from the pilot pump 15 via the pilot line 25 and generates the pilot pressure. Then, through the pilot line 25*a*, the pilot pressure is applied to the pilot port of the corresponding flow rate control valve. The pilot pressure changes according to the operation direction and the operation amount of the operation device 26. The operation device 26 may be operated remotely. In this case, the operation device 26 generates the pilot pressure according to the information on the operation direction and the operation amount received via wireless communication.

The controller 30 is a control device for controlling the excavator. In the present embodiment, the controller 30 is constituted by a computer including a CPU, a RAM, and a ROM, etc. The CPU of the controller 30 reads programs corresponding to various functions from the ROM, loads the programs in the RAM, and executes the programs to implement functions corresponding to the respective programs.

For example, the controller 30 implements the function of controlling the discharge flow rate of the main pump 14. More specifically, the controller 30 changes the control current with respect to the regulator 14*a* according to negative control pressure, and controls the discharge flow rate of the main pump 14 via the regulator 14*a*.

The engine control device 74 controls the engine 11. For example, the engine control device 74 controls the fuel injection amount, etc., so that the engine revolution speed set through the input device is implemented.

An operation mode switching dial 76 is a dial for switching the operation mode of the excavator, and is provided in the cabin 10. In the present embodiment, the operator can switch between an M (manual) mode and an SA (semiautomatic) mode. The controller 30, for example, switches the operation mode of the excavator in accordance with the output of the operation mode switching dial 76. FIG. 12 illustrates a state in which the SA mode is selected by the operation mode switching dial 76.

The M mode is a mode in which the excavator is operated in accordance with the contents of the operation input, to the operation device 26 by the operator. For example, the M mode is a mode in which the boom cylinder 7, the arm cylinder 8, and the bucket cylinder 9 are operated in accordance with the contents of the operation input to the operation device 26 by the operator. The SA mode is a mode in which the excavator is automatically operated regardless of the content of the operation input to the operation device 26, when a predetermined condition is satisfied. For example, the SA mode is a mode that when the predetermined condition is satisfied, the boom cylinder 7, the arm cylinder 8, and the bucket cylinder 9 are automatically operated, regardless of the content of the operation input to the operation device 26. The operation mode switching dial 76 may be configured to be capable of switching among three or more operation modes.

The display device 40 is a device for displaying various kinds of information and is disposed in the vicinity of the driver's seat in the cabin 10. In the present embodiment, the display device 40 includes the image display unit 41 and the input unit 42. The operator can input information and instructions to the controller 30 by using the input unit 42. Furthermore, the operator can recognize the driving situation and control information of the excavator by looking at the image display unit 41. The display device 40 is connected to the controller 30 via a communication network such as CAN and LIN, etc. The display device 40 may be connected to the controller 30 via an exclusive-use line.

The display device 40 operates by being supplied with electric power from the storage battery 70. The storage battery 70 is charged with electric power generated by the alternator 11*a*. The electric power of the storage battery 70 is also supplied to elements other than the controller 30 and the display device 40, such as the electrical components 72, etc., of the excavator. The starter 11*b* of the engine 11 is driven by electric power from the storage battery 70 to start the engine 11.

The engine 11 is controlled by the engine control device 74. The engine control device 74 transmits various kinds of data indicating the state of the engine 11 (for example, data indicating the cooling water temperature (physical quantity) detected by the water temperature sensor 11*c*), to the controller 30. The controller 30 can accumulate these kinds of data in the temporary storage unit (memory) 30*a* and can transmit toe data to the display device 40 as needed. The same applies to data indicating the swash plate tilt angle output from the regulator 14*a*, data indicating the discharge pressure of the main pump 14 output by the discharge pressure sensor 14*b*, data indicating the temperature of the hydraulic oil output by the oil temperature sensor 14*c*, and data indicating the pilot pressure output from the pilot pressure sensors 15*a* and 15*b*, etc.

A cylinder pressure sensor S1 is an example of an excavation load information detecting device that detects information relating to the excavation load, detects the cylinder pressure of a hydraulic cylinder, and outputs the detection data to the controller 30. In the present embodiment, the cylinder pressure sensor S1 includes cylinder pressure sensors S11 to S16. Specifically, the cylinder pressure sensor S11 detects the boom bottom pressure, which is the pressure of the hydraulic oil in the bottom-side oil chamber of the boom cylinder 7. The cylinder pressure sensor S12 detects the boom rod pressure, which is the pressure of the hydraulic oil in the rod side oil chamber of the boom cylinder 7. Similarly, the cylinder pressure sensor S13 detects the arm bottom pressure, the cylinder pressure sensor S14 detects the arm rod pressure, the cylinder pressure sensor S15 detects the bucket bottom pressure, and the cylinder pressure sensor S16 detects the bucket rod pressure.

A control valve E2 is a valve that operates in accordance with an instruction from the controller 30. In the present embodiment, the control valve E2 is used for forcibly operating the flow rate control valve relating to a predetermined hydraulic cylinder, regardless of the content of the operation input to the operation device 26.

Figure 13:
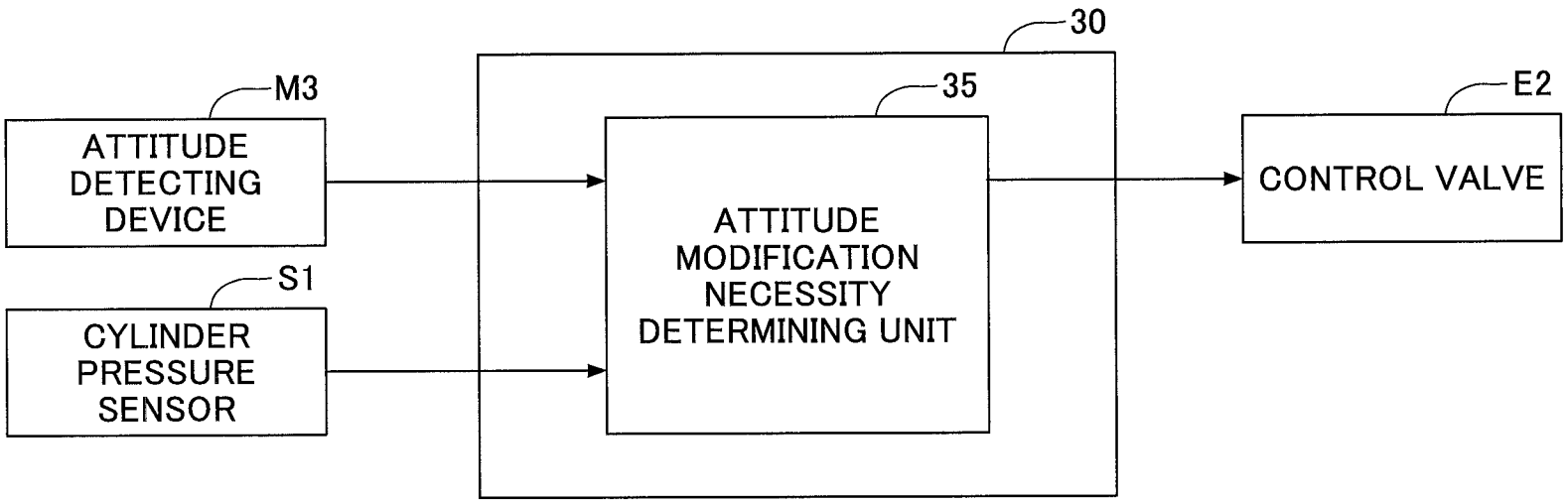
FIG. 13 is a diagram illustrating a configuration example of an excavator control system installed in the excavator of FIG. 10.

FIG. 13 is a diagram illustrating a configuration example of an excavator control system installed in the excavator of FIG. 10. The excavator control system mainly includes the attitude detecting device M3, the cylinder pressure sensor S1, the controller 30, and the control valve E2. The controller 30 includes an attitude modification necessity determining unit 35.

The attitude modification necessity determining unit 35 is a functional element for determining whether the attitude of the excavator attachment performing excavation, should be modified. For example, when determining that there is a possibility that the excavation load may become excessively high, the attitude modification necessity determining unit 35 determines that the attitude of the excavator attachment performing excavation, should be modified.

In the present embodiment, the attitude modification necessity determining unit 35 derives the excavation load based on the output of the cylinder pressure sensor S1, and records the excavation load. Furthermore, the attitude modification necessity determining unit 35 derives an empty excavation load (tare excavation load) corresponding to the attitude of the excavator attachment detected by the attitude detecting device M3. Then, the attitude modification necessity determining unit 35 calculates the net excavation load by subtracting the empty excavation load from the excavation load, and determines whether the attitude of the excavator attachment should be modified based on the net excavation load.

"Excavation" means to move the excavator attachment while bringing the excavator attachment into contact with an excavation target such as earth and sand, and "empty excavation" means to move the excavator attachment without bringing the excavator attachment into contact with any object.

"Excavation load" means the load when moving the excavator attachment while bringing the excavator attachment into contact with the excavation target, and "empty excavation load" means the load when moving the excavator attachment without contacting any object.

"Excavation load", "empty excavation load", and "net excavation load" are represented by arbitrary physical quantities such as cylinder pressure, cylinder thrust, excavation torque (moment of excavation force), and excavation reaction force, etc. For example, the net cylinder pressure, as a net excavation load, is expressed as a value obtained by subtracting the empty excavation cylinder pressure, as an empty excavation load, from the cylinder pressure, as an excavation load. The same applies to cases where the cylinder thrust, the excavation torque (moment of excavation force), and the excavation reaction force, etc.

As the cylinder pressure, for example, the detection value of the cylinder pressure sensor S1 is used. The detection value of the cylinder pressure sensor S1 is, for example, boom bottom pressure (P11), boom rod pressure (P12), arm bottom pressure (P13), arm rod pressure (P14), bucket bottom Pressure (P15), and bucket rod pressure (P16).

The cylinder thrust is calculated, for example, based on the cylinder pressure and the pressure receiving area of the piston sliding in the cylinder. For example, as illustrated in FIG. 11, the boom cylinder thrust (f1) is expressed by obtaining a cylinder extension force that is the product (P11×A11) of the boom bottom pressure (P11) and the pressure receiving area (A11) of the piston in the boom bottom side oil chamber, and obtaining a cylinder contraction force that is the product (P12×A12) of the boom rod pressure (P12) and the pressure receiving area (A12) of the piston in the boom rod side oil chamber, and then obtaining the difference between the cylinder extension force and the cylinder contraction force (P12×A11−P12×A12). The same applies to the arm cylinder thrust (f2) and the bucket cylinder thrust (f3).

The excavation torque is calculated based on, for example, the attitude of the excavator attachment and the cylinder thrust. For example, as illustrated in FIG. 11, the magnitude of the bucket excavation torque (τ3) is expressed by a value obtained by multiplying the magnitude of the bucket cylinder thrust (f3) by a distance G3 between the action line of the bucket cylinder thrust (f3) and the bucket connecting pin position P3. The distance G3 is a function of the bucket angle (θ3) and is an example of the link gain. The same applies to the boom excavation torque (τ1) and the arm excavation torque (τ2).

The excavation reaction force is calculated based on, for example, the attitude of the excavator attachment and the excavation load. For example, the excavation reaction force F is calculated based on a function (mechanism function) having a physical quantity representing the attitude of the excavator attachment as an argument and a function having a physical quantity representing the excavation load as an argument. More specifically, as illustrated in FIG. 11, the excavation reaction force F is calculated as a product of a mechanism function with the arguments of the boom angle (θ1), the arm angle (θ2), and the bucket angle (θ3), and a function with the arguments of the boom excavation torque (τ1), the arm excavation torque (τ2), and the bucket excavation torque (τ3). The function with the arguments of the boom excavation torque (τ1), the arm excavation torque (τ2), and the bucket excavation torque (τ3) may be a function with the arguments of the boom cylinder thrust (f1), the arm cylinder thrust (f2), and the bucket cylinder thrust (f3).

The function with arguments of the boom angle (θ1), the arm angle (θ2), and the bucket angle (θ3) may be based on a balance equation of force, may be based on Jacobian, or may be based on the principle of virtual work.

In this way, the excavation load is derived based on the detection values of the various sensors at the present time point. For example, the detection value of the cylinder pressure sensor S1 may be directly used as the excavation load. Alternatively, the cylinder thrust calculated based on the detection value of the cylinder pressure sensor S1 may be used as the excavation load. Alternatively, the excavation torque calculated from the cylinder thrust, which is calculated based on the detection value of the cylinder pressure sensor S1, and the attitude of the excavator attachment, which is derived based on the detection value of the attitude detecting device M3, may be used as the excavation load. The same applies to the excavation reaction force.

On the other hand, the empty excavation load may be stored in advance in association with the attitude of the excavator attachment. For example, an empty excavation cylinder pressure table may be used, in which the empty excavation cylinder pressure as the empty excavation load is associated with a combination of the boom angle (θ1), the arm angle (θ2), and the bucket angle (θ3), and stored so as to be referable. Alternatively, an empty excavation cylinder thrust table may be used, in which the empty excavation cylinder thrust as the empty excavation load is associated with a combination of the boom angle (θ1), the arm angle (θ2), and the bucket angle (θ3), and stored so as to be referable. The same applies to an empty excavation torque table and an empty excavation reaction force table. The empty excavation cylinder pressure table, the empty excavation cylinder thrust table, the empty excavation torque table, and the empty excavation reaction force table may be generated based on data acquired when empty excavation is performed with an actual excavator, for example, and stored in the ROM, etc., of the controller 30 in advance. Alternatively, these tables may be generated based on a simulation result derived by a simulator device such as an excavator simulator. Furthermore, instead of the reference table, a calculation formula such as a multiple regression equation, etc., based on multiple regression analysis, may be used. In the case of using a multiple regression equation, the empty excavation load is calculated in real-time based on a combination of the boom angle (θ1), the arm angle (θ2), and the bucket angle (θ3) at the present time point, for example.

Furthermore, the empty excavation cylinder pressure table, the empty excavation cylinder thrust table, the empty excavation torque table, and the empty excavation reaction force table may be prepared for each operating speed of the excavator attachment such as high speed, medium speed, and low speed. Also, these tables may be prepared for each operation content of the excavator attachment, such as when the arm is closed, when the arm is opened, when the boom is raised, and when the boom is lowered.

When the net excavation load at the present time point is greater than or equal to a predetermined value, the attitude modification necessity determining unit 35 determines that the excavation load may become excessively high. For example, when the net cylinder pressure as the net excavation load becomes greater than or equal to predetermined cylinder pressure, the attitude modification necessity determining unit 35 determines that there is a possibility that the cylinder pressure as the excavation load may become excessively high. The predetermined cylinder pressure may be a variable value that varies according to a change in the attitude of the excavator attachment, or may be a fixed value that does not vary according to a change in the attitude of the excavator attachment.

Then, if it is determined that there is a possibility that the excavation load may become excessively high when driving while the operation mode is the SA (semiautomatic) mode, the attitude modification necessity determining unit 35 determines that the attitude of the excavator attachment performing excavation should be modified, and outputs an instruction to the control valve E2.

The control valve E2 that has received the instruction from the attitude modification necessity determining unit 35 forcibly operates the flow rate control valve related to the predetermined hydraulic cylinder to adjust the excavator depth, regardless of the content of the operation input to the operation device 26. In the present embodiment, the control valve E2 forcibly extends the boom cylinder 7 by forcibly moving the flow rate control valve associated with the boom cylinder 7, even when the boom operation lever is not operated. As a result, the excavation depth can be made shallow, by forcibly raising the boom 4. Alternatively, even when the bucket operation lever is not operated, the control valve E2 may forcibly expand and contract the bucket cylinder 9 by forcibly moving the flow rate control valve related to the bucket cylinder 9. In this case, by forcibly opening and closing the bucket 6, the bucket, toe angle can be adjusted, and the excavation depth can be made shallow. The bucket toe angle is, for example, the angle of the toe of the bucket 6 with respect to the horizontal plane. In this manner, the control valve E2 can forcibly extend and contract at least one of the boom cylinder 7, the arm cylinder 8, and the bucket cylinder 9, thereby making the excavation depth shallow.

Figure 14:
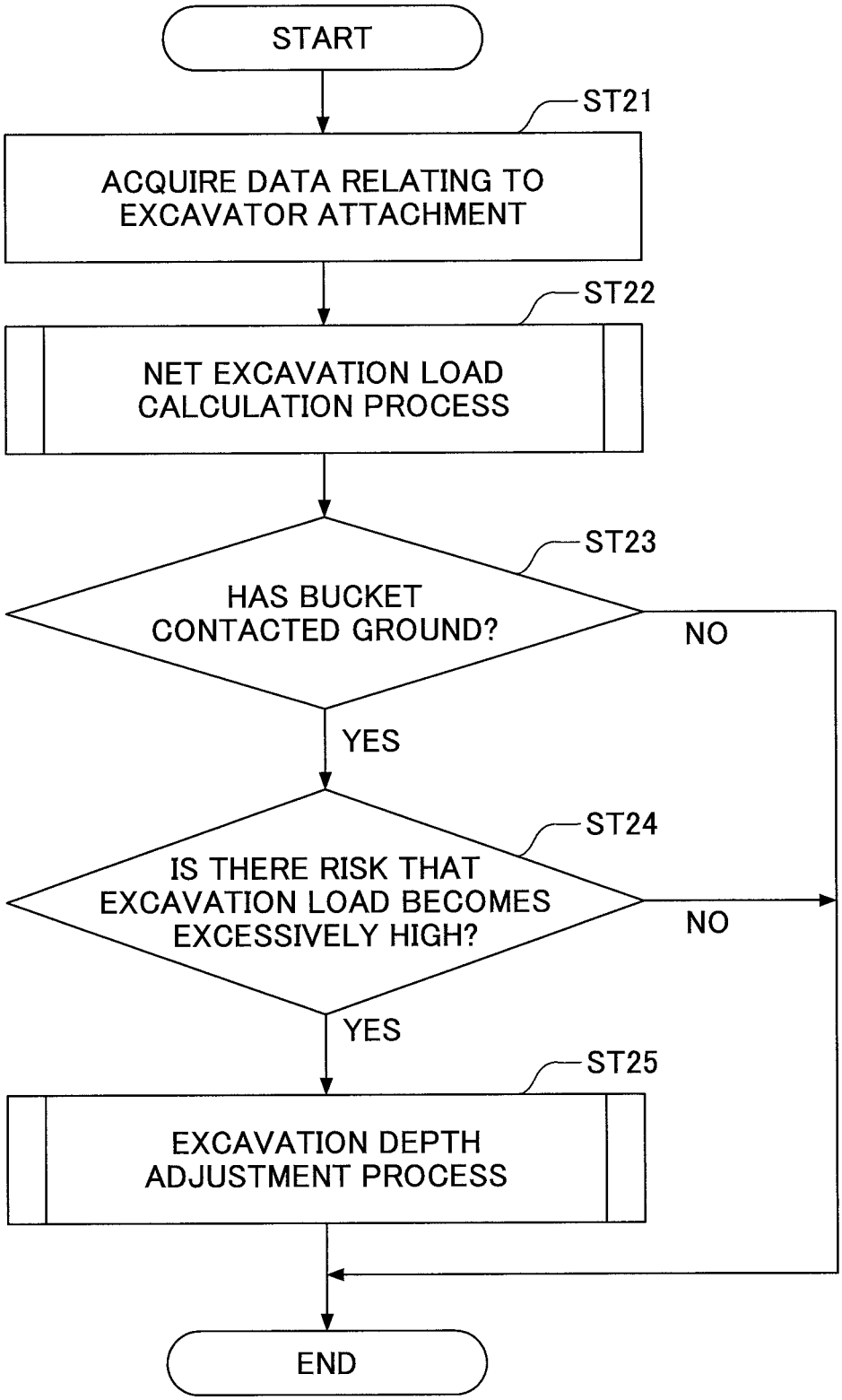
FIG. 14 is a flowchart of an attitude modification necessity determination process.

Next, referring to FIG. 14, the flow of a process in which the controller 30 determines whether it is necessary to modify the attitude of the excavator attachment during excavation by an arm closing motion (hereinafter referred to as an "attitude modification necessity determination process"), will be described. FIG. 14 is a flowchart of an attitude modification necessity determination process. When the operation mode is set to the SA (semiautomatic) mode, the controller 30 repeatedly executes this attitude modification necessity determination process at a predetermined control cycle.

First, the attitude modification necessity determining unit 35 of the controller 30 acquires data relating to the excavator attachment (step ST21). For example, the attitude modification necessity determining unit 35 acquires the boom angle (θ1), the arm angle (θ2), the bucket angle (θ3), and the cylinder pressure (P11 to P16), etc.

Subsequently, the attitude modification necessity determining unit 35 executes a net excavation load calculation process to calculate the net excavation load (step ST22). Details of the net excavation load calculation process will be described later.

Subsequently, the attitude modification necessity determining unit 35 determines whether the bucket 6 is in contact with the ground (step ST23). The attitude modification necessity determining unit 35 determines whether the bucket 6 is in contact with the ground based on outputs from the pilot pressure sensors 15*a* and 15*b*, and the cylinder pressure sensors S11 through S16, etc., for example. For example, when the arm bottom pressure (P13), which is the pressure of the hydraulic oil in the expansion side oil chamber during the arm closing operation, is greater than or equal to a predetermined value, it is determined that the bucket 6 is in contact with the ground. Whether the arm closing operation is performed is determined based on outputs of the pilot pressure sensors 15*a* and 15*b*.

When it is determined that the bucket 6 is in contact with the ground (YES in step ST23), the attitude modification necessity determining unit 35 determines whether there is a possibility that the excavation load may become excessively high (step ST24). For example, when the net excavation load calculated in the net excavation load calculating process is greater than or equal to the predetermined value, the attitude modification necessity determining unit 35 determines that there is a possibility that the excavation load may become excessively high.

When it is determined that the excavation load is likely to be excessively high (YES in step ST24), the attitude modification necessity determining unit 35 executes an excavation depth adjustment process because it is necessary to modify the attitude of the excavator attachment (step ST25). For example, the attitude modification necessity determining unit 35 outputs an instruction to the control valve E2 to forcibly extend the boom cylinder 7 by forcibly moving the flow rate control valve related to the boom cylinder 7. As a result, the excavation depth can be made shallow by forcibly raising the boom 4, regardless of whether or not there is any operation input to the boom operation lever. Alternatively, the attitude modification necessity determining unit 35 may forcibly extend and contract the bucket cylinder 9 by forcibly moving the flow rate control valve related to the bucket cylinder 9. As a result, the excavation depth can be made shallow by forcibly opening and closing the bucket 6, regardless of whether or not there is any operation input to the bucket operation lever.

When it is determined that the bucket 6 is not in contact with the ground (NO in step ST23) or when it is determined that the excavation load is not likely to be excessively high (NO in step ST24), the attitude modification necessity determining unit 35 terminates the present attitude modification necessity determination process without executing the excavation depth adjustment process.

In the above-described embodiment, the attitude modification necessity determining unit 35 determines whether there is a possibility that the excavation load may become excessively high; however, it may be determined whether there is a possibility that the excavation load may become excessively low.

Then, even when it is determined that there is a possibility that the excavation load may become excessively low, the attitude modification necessity determining unit 35 may execute the excavation depth adjustment process because it is necessary to modify the attitude of the excavation attachment.

In this case, the attitude modification necessity determining unit 35 outputs an instruction to the control valve E2, and forcibly causes the boom cylinder 7 to contract by forcibly moving the flow rate control valve related to the boom cylinder 7. As a result, regardless of whether or not there is any operation input to the boom operation lever, the excavation depth can be made deep by forcibly lowering the boom 4. Alternatively, the attitude modification necessity determining unit 35 may forcibly extend and contract the bucket cylinder 9 by forcibly moving the flow rate control valve related to the bucket cylinder 9. As a result, the excavation depth can be made deep by forcibly opening and closing the bucket 6, regardless of whether or not there is any operation input to the bucket operation lever.

Furthermore, the attitude modification necessity determining unit 35 is used not only for controlling the attachment during excavation, but also for controlling the bucket toe angle in the initial stage of excavation in which the toe of the bucket contacts the ground as illustrated in FIGS. 7 and 8.

Figure 15:
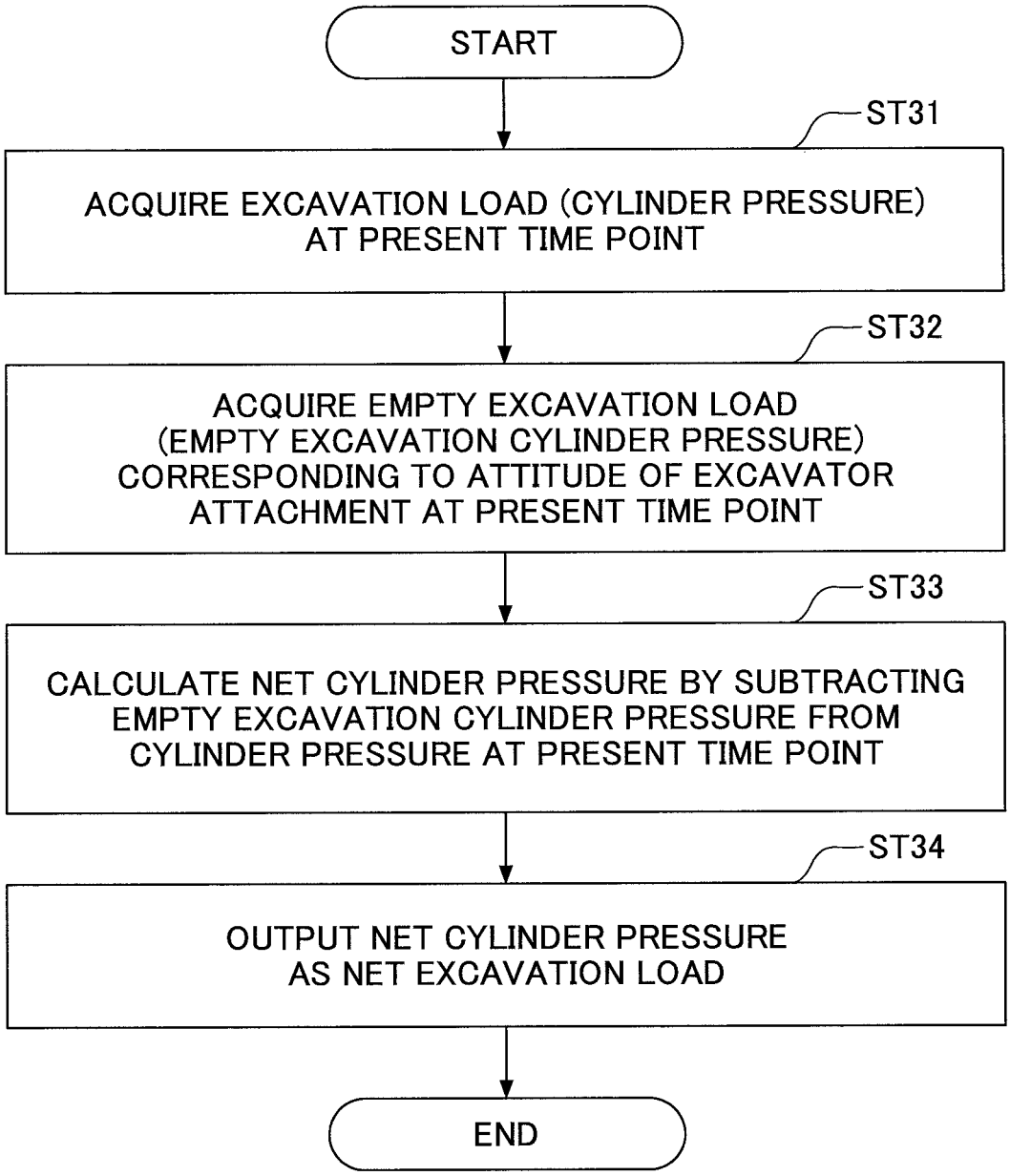
FIG. 15 is a flowchart illustrating an example of the flow of a net excavation load calculation process.

Next, with reference to FIG. 15, the flow of the net excavation load calculation process will be described. FIG. 15 is a flowchart illustrating an example of the flow of the net excavation load calculation process.

First, the attitude modification necessity determining unit 35 acquires the cylinder pressure as the excavation load at the present time point (step ST31). The cylinder pressure at the present time point includes, for example, the boom bottom pressure (P11) detected by the cylinder pressure sensor S11. The same applies to the boom rod pressure (P12), the arm bottom pressure (P13), the arm rod pressure (P14), the bucket bottom pressure (P15), and the bucket rod pressure (P16).

Subsequently, the attitude modification necessity determining unit 35 acquires the empty excavation cylinder pressure as an empty excavation load corresponding to the attitude of the excavator attachment at the present time point (step ST32). For example, by referring to the empty excavation cylinder pressure table by using, as search keys, the boom angle (θ1), the arm angle (θ2) and the bucket angle (θ3) at the present time point, the empty excavation cylinder pressure stored in advance is derived. The empty excavation cylinder pressure is at least one of, for example, empty excavation boom bottom pressure, empty excavation boom rod pressure, empty excavation arm bottom pressure, empty excavation arm rod pressure, empty excavation bucket bottom pressure, and empty excavation bucket rod pressure.

Subsequently, the attitude modification necessity determining unit 35 calculates the net cylinder pressure by subtracting the empty excavation cylinder pressure corresponding to the attitude of the excavator attachment at the present time point, from the cylinder pressure at the present time point (step ST33). The net cylinder pressure includes, for example, the net boom bottom pressure obtained by subtracting the empty excavation boom bottom pressure from the boom bottom pressure (P11). The same applies to the net boom rod pressure, the net arm bottom pressure, the net arm rod pressure, the net bucket bottom pressure, and the net bucket rod pressure.

Subsequently, the attitude modification necessity determining unit 35 outputs the calculated net cylinder pressure as a net excavation load (step ST34).

When six net cylinder pressures have been derived as the net excavation load, the attitude modification necessity determining unit 35 determines whether there is a possibility that the excavation load may become excessively high, based on at least one of the six net cylinder pressures. The six net cylinder pressures are the net boom bottom pressure, the net boom rod pressure, the net arm bottom pressure, the net arm rod pressure, the net bucket bottom pressure, and the net bucket rod pressure. For example, when the net arm bottom pressure is greater than or equal to a first predetermined pressure value, and the net boom bottom pressure is greater than or equal to a second predetermined pressure value, the attitude modification necessity determining unit 35 may determine that the excavation load may become excessively high. Alternatively, the attitude modification necessity determining unit 35 may determine that there is a possibility that the excavation load may become excessively high, when the net arm bottom pressure is greater than or equal to the first predetermined pressure value.

Figure 16:
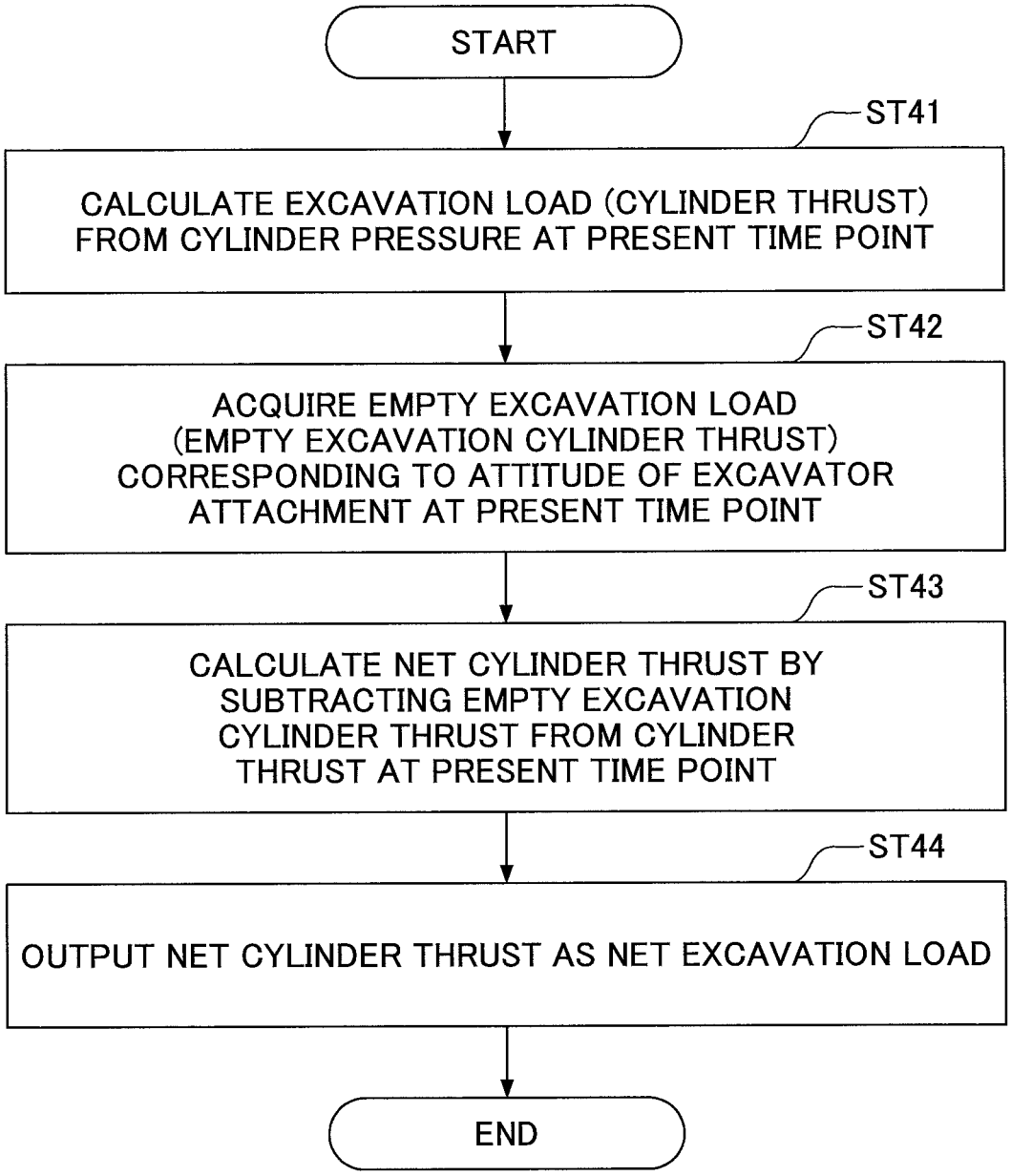
FIG. 16 is a flowchart illustrating another example of the flow of the net excavation load calculation process.

Next, another example of the net excavation load calculation process will be described with reference to FIG. 16. FIG. 16 is a flowchart illustrating another example of the flow of the net excavation load calculation process. The process in FIG. 16 is different from the process in FIG. 15 using the cylinder pressure, in that the cylinder thrust is used as the excavation load at the present time point.

First, the attitude modification necessity determining unit 35 calculates the cylinder thrust as the excavation load from the cylinder pressure at the present time point (step ST41). The cylinder thrust at the present time point is, for example, the boom cylinder thrust (f1). The boom cylinder thrust (f1) is expressed by obtaining a cylinder extension force that is the product (P11×A11) of the boom bottom pressure (P11) and the pressure receiving area (A11) of the piston in the boom bottom side oil chamber, and obtaining a cylinder contraction force that is the product (P12×A12) of the boom rod pressure (P12) and the pressure receiving area (A12) of the piston in the boom rod side oil chamber, and then obtaining the difference between the cylinder extension force and the cylinder contraction force (P12×A11−P12×A12). The same applies to the arm cylinder thrust (f2) and the bucket cylinder thrust (f3).

Subsequently, the attitude modification necessity determining unit 35 acquires the empty excavation cylinder thrust as the empty excavation load corresponding to the attitude of the excavator attachment at the present time point (step ST42). For example, by referring to the empty excavation cylinder thrust table by using, as search keys, the boom angle (θ1), the arm angle (θ2) and the bucket angle (θ) at the present time point, the empty excavation cylinder thrust stored in advance is derived. The empty excavation cylinder thrust includes at least one of, for example, an empty excavation boom cylinder thrust, an empty excavation arm cylinder thrust, and an empty excavation bucket cylinder thrust.

Subsequently, the attitude modification necessity determining unit 35 calculates the net cylinder thrust by subtracting the empty excavation cylinder thrust from the cylinder thrust at the present time point (step ST43). The net cylinder thrust includes, for example, a net boom cylinder thrust that is obtained by subtracting the empty excavation boom cylinder thrust from the boom cylinder thrust (f1) at the present time point. The same applies to the net arm, cylinder thrust and the net bucket cylinder thrust.

Subsequently, the attitude modification necessity determining unit 35 outputs the calculated net cylinder thrust as a net excavation load (step ST44).

When three net cylinder thrusts have been derived as the net excavation load, the attitude modification necessity determining unit 35 determines whether there is a possibility that the excavation load may become excessively high, based on at least one of the three net cylinder thrusts. The three net cylinder thrusts are the net boom cylinder thrust, the net arm cylinder thrust, and the net bucket cylinder thrust. For example, when the net arm cylinder thrust is greater than or equal to a first predetermined thrust value and the net boom cylinder thrust is greater than or equal to a second predetermined thrust value, the attitude modification necessity determining unit 35 may determine that the excavation load may become excessively high. Alternatively, the attitude modification necessity determining unit 35 may determine that the excavation load may become excessively high when the net arm cylinder thrust is greater than or equal to the first predetermined thrust value.

Alternatively, when three net excavation torques have been derived as the net excavation load, the attitude modification necessity determining unit 35 may determine whether there is a possibility that the excavation load may become excessively high, based on at least one of the three net excavation torques. The three net excavation torques are the net boom excavation torque, the net arm excavation torque, and the net bucket excavation torque. For example, when the net arm excavation torque is greater than or equal to a first predetermined torque value and the net boom excavation torque is greater than or equal to a second predetermined torque value, the attitude modification necessity determining unit 35 may determine that the excavation load may become excessively high. Alternatively, the attitude modification necessity determining unit 35 may determine that the excavation load may become excessively high when the net arm excavation torque is greater than or equal to the first predetermined torque value.

Figure 17:
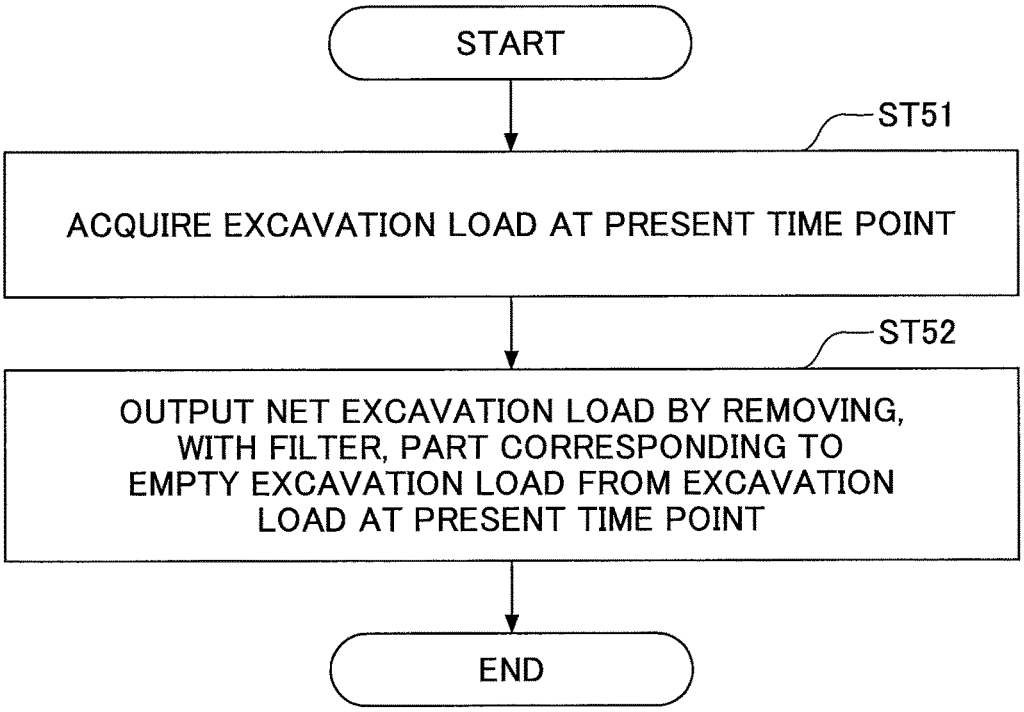
FIG. 17 is a flowchart illustrating yet another example of the flow of the net excavation load calculation process.

Next, another example of the net excavation load calculation process will be described with reference to FIG. 17. FIG. 17 is a flowchart illustrating yet another example of the flow of the net excavation load calculation process. In the process of FIG. 17, a part corresponding to the empty excavation load is removed from the excavation load with a filter, to derive the net excavation load; this is different from the processes of FIGS. 15 and 16 in which the empty excavation load, which is derived by using a reference table, is subtracted from the excavation load, to derive the net excavation load.

First, the attitude modification necessity determining unit 35 acquires the excavation load at the present time point (step ST51). The excavation load at the present time point may be any one of the cylinder pressure, the cylinder thrust, the excavation torque (moment of excavating force), or the excavation reaction force.

Subsequently, the attitude modification necessity determining unit 35 removes, with a filter, the part corresponding to the empty excavation load from the excavation load at the present time point, and outputs the net excavation load (step ST52). For example, the attitude modification necessity determining unit 35 takes an electric signal output by the cylinder pressure sensor S1, as an electric signal including a frequency component derived from the empty excavation load and other frequency components, and uses a band elimination filter to remove the frequency components derived from the empty excavation load, from the electrical signal.

With the above-described configuration, the controller 30 can derive the net excavation load at the present time point with high accuracy, and thereby making it possible to determine, with high accuracy, whether the excavation load may become excessively high. When it is determined that there is a possibility that the excavation load may become excessively high, the attitude of the excavator attachment can be automatically modified so that the excavation depth becomes shallow. As a result, it is possible to prevent the motion of the excavator attachment from stopping due to an excessive load during the excavating operation, and it is possible to implement an efficient excavation operation.

Furthermore, the controller 30 can derive the net excavation load at the present time point with high accuracy, thereby making it possible to determine, with high accuracy, whether the excavation load may become excessively low. When it is determined that there is a possibility that the excavation load may become excessively low, the attitude of the excavator attachment can be automatically modified so that the excavation depth becomes deep. As a result, it is possible to prevent the excavation amount from being excessively reduced by one excavation operation, and to implement an efficient excavation operation.

In this manner, the controller 30 can automatically modify the attitude of the excavator attachment during the excavation operation so that the excavation reaction force has an appropriate magnitude. Therefore, accurate positioning control of the toe of the bucket 6 can be implemented.

Furthermore, the controller 30 can calculate the excavation reaction force in consideration of not only the bucket excavation torque but also the boom excavation torque and the arm excavation torque. Therefore, the excavation reaction force can be derived with high accuracy.

Furthermore, the controller 30 may be used not only for controlling the attachment during excavation but also for controlling the bucket toe angle at the initial stage of excavation in which the toe of the bucket contacts the ground as illustrated in FIGS. 7 and 8.

For example, in the embodiments described above, the external computing device 30E is described as a separate computing device outside the controller 30, but the external computing device 30E may be integrally combined with the controller 30. Instead of the controller 30, the external computing device 30E may directly control the motion control unit E1.

In the embodiments described above, the topography database updating unit 31 acquires the topography information of the work site through the communication device M1 at the time of activating the excavator, and updates the topography database. However, the present invention is not limited to this configuration. For example, the topography database updating unit 31 may acquire the topography information of the work site based on the image of the surroundings of the excavator captured by the imaging device M5 and update the topography database without using the information relating to the transition of the attitude of the attachment.

In the above embodiments, a cylinder pressure sensor is used as an example of the excavation load information detecting device; however, another sensor such as a torque sensor may be used as the excavation load information detecting device.

It should be understood that the invention is not limited to the above-described embodiment, but may be modified into various forms on the basis of the spirit of the invention. Additionally, the modifications are included in the scope of the invention.

What is claimed is:

1. An excavator comprising:

a lower traveling body;

an upper turning body mounted on the lower traveling body;

an attachment attached to the upper turning body;

an attitude sensor configured to detect an attitude of the attachment including a bucket; and a hardware processor configured to change a toe angle of the bucket with respect to a present shape of an excavation ground as a shape of the excavation ground changes during the bucket excavating the excavation ground, based on the attitude of the attachment detected by the attitude sensor and information relating to the present shape of the excavation ground, the toe angle being an angle of a toe of the bucket to the excavation ground, the present shape of the excavation ground being an actual shape of the excavation ground presently below the attachment.

2. The excavator according to claim 1, wherein the hardware processor is configured to control the toe angle to be approximately 90 degrees with respect to the present shape of the excavation ground, when the toe of the bucket contacts the excavation ground.

3. The excavator according to claim 1, wherein the hardware processor is configured to control the toe angle to be an angle within a predetermined angle range, when drawing the bucket, which is inserted in the excavation ground, toward a body of the excavator.

4. The excavator according to claim 1, wherein the hardware processor is configured to increase the toe angle from a present toe angle upon determining that an excavation reaction force is greater than a predetermined value, when drawing the bucket, which is inserted in the excavation ground, toward a body of the excavator.

5. The excavator according to claim 1, wherein the hardware processor is configured to decrease the toe angle from a present toe angle upon determining that an excavation reaction force is greater than a predetermined value, when raising the bucket that is inserted in the excavation ground.

6. The excavator according to claim 1, wherein the hardware processor is configured to determine a present stage of excavation from among a plurality of stages of the excavation, based on an operation content of an operation device relating to the attachment during the excavation.

7. The excavator according to claim 6, wherein the hardware processor is configured to calculate the toe angle based on the attitude of the attachment detected by the attitude sensor and the information relating to the present shape of the excavation ground, and control the calculated toe angle according to the determined present excavation stage.

8. The excavator according to claim 1, wherein the present shape of the excavation ground is acquired based on a past transition of the attitude of the attachment detected by the attitude sensor or an image of surroundings of the excavator captured by an imaging device.

9. The excavator as claimed in claim 1, wherein the hardware processor is configured to change the toe angle of the bucket to gradually close the bucket as the shape of the excavation ground changes during the bucket excavating the excavation ground.

10. An excavator comprising:

a lower traveling body;

an upper turning body mounted on the lower traveling body;

an attachment attached to the upper turning body;

an attitude sensor configured to detect an attitude of the attachment including a bucket; and a hardware processor configured to change a toe angle of the bucket with respect to a present shape of an excavation ground while a toe of the bucket is inserted into the excavation ground, based on the attitude of the attachment detected by the attitude sensor and information relating to the present shape of the excavation ground, the toe angle being an angle of the toe of the bucket to the excavation ground, the present shape of the excavation ground being an actual shape of the excavation ground presently below the attachment.

11. An excavator comprising:

a lower traveling body;

an upper turning body mounted on the lower traveling body;

an attachment attached to the upper turning body;

an attitude sensor configured to detect an attitude of the attachment including a bucket; and a hardware processor configured to change a toe angle of the bucket according to a shape of an excavation ground while the bucket is moved through the excavation ground, based on the attitude of the attachment detected by the attitude sensor and information relating to a present shape of the excavation ground, the toe angle being an angle of a toe of the bucket to the excavation ground, the present shape of the excavation ground being an actual shape of the excavation ground presently below the attachment.

* * * * *